US009886967B2

(12) United States Patent
Vishnubhotla et al.

(10) Patent No.: US 9,886,967 B2
(45) Date of Patent: Feb. 6, 2018

(54) SYSTEMS AND METHODS FOR SPEECH EXTRACTION

(71) Applicant: University of Maryland, College Park, College Park, MD (US)

(72) Inventors: Srikanth Vishnubhotla, Minnetonka, MN (US); Carol Espy-Wilson, Atlanta, GA (US)

(73) Assignee: University of Maryland, College Park, College Park, MD (US)

( * ) Notice: Subject to any disclaimer, the term of this patent is extended or adjusted under 35 U.S.C. 154(b) by 0 days.

(21) Appl. No.: 14/824,623

(22) Filed: Aug. 12, 2015

(65) Prior Publication Data

US 2016/0203829 A1 Jul. 14, 2016

Related U.S. Application Data

(63) Continuation of application No. 13/018,064, filed on Jan. 31, 2011, now abandoned.

(60) Provisional application No. 61/299,776, filed on Jan. 29, 2010.

(51) Int. Cl.

| | |
|---|---|
| ***G10L 21/00*** | (2013.01) |
| ***G10L 21/0308*** | (2013.01) |
| ***G10L 19/008*** | (2013.01) |
| ***G10L 19/09*** | (2013.01) |
| ***G10L 21/0272*** | (2013.01) |

(Continued)

(52) U.S. Cl.

CPC ..... *G10L 21/0308* (2013.01); *G10L 19/008* (2013.01); *G10L 19/09* (2013.01); *G10L 21/0272* (2013.01); *G10L 2025/786* (2013.01); *G10L 2025/906* (2013.01)

(58) Field of Classification Search

USPC ..... 704/203–209, 214, 220, 245, 267–269

See application file for complete search history.

(56) References Cited

U.S. PATENT DOCUMENTS

| | | | |
|---|---|---|---|
| 6,493,665 | B1 | 12/2002 | Su et al. |
| 6,507,814 | B1 | 1/2003 | Gao |
| 6,801,887 | B1 | 10/2004 | Heikkinen et al. |

(Continued)

OTHER PUBLICATIONS

Mahadevan, V. et al., "Subjective Evaluation of Speech Quality from Speech Enhancement and Segregation Algorithms", Meeting of the Acoustical Society of America, Baltimore, Maryland, Apr. 20, 2010, pp. 1-58.

(Continued)

*Primary Examiner* — Leonard Saint Cyr

(74) *Attorney, Agent, or Firm* — Cooley LLP

(57) ABSTRACT

In some embodiments, a processor-readable medium stores code representing instructions to cause a processor to receive an input signal having a first component and a second component. An estimate of the first component of the input signal is calculated based on an estimate of a pitch of the first component of the input signal. An estimate of the input signal is calculated based on the estimate of the first component of the input signal and an estimate of the second component of the input signal. The estimate of the first component of the input signal is modified based on a scaling function to produce a reconstructed first component of the input signal. The scaling function is a function of at least one of the input signal, the estimate of the first component of the input signal, the estimate of the second component of the input signal, or a residual signal.

17 Claims, 13 Drawing Sheets

(51) Int. Cl.
*G10L 25/78* (2013.01)
*G10L 25/90* (2013.01)

(56) References Cited

U.S. PATENT DOCUMENTS

| | | | |
|---|---|---|---|
| 2002/0072904 | A1 | 6/2002 | Chen |
| 2003/0182106 | A1 | 9/2003 | Bitzer et al. |
| 2004/0054527 | A1 | 3/2004 | Quatieri, Jr. |
| 2007/0083365 | A1 | 4/2007 | Shmunk |
| 2008/0046236 | A1 | 2/2008 | Thyssen et al. |
| 2009/0059960 | A1 | 3/2009 | Li |
| 2009/0076814 | A1 | 3/2009 | Lee |
| 2009/0213845 | A1 | 8/2009 | Li |
| 2009/0326962 | A1 | 12/2009 | Chen et al. |
| 2010/0017205 | A1 | 1/2010 | Visser et al. |
| 2011/0071824 | A1 | 3/2011 | Espy-Wilson et al. |
| 2011/0191102 | A1 | 8/2011 | Espy-Wilson et al. |

OTHER PUBLICATIONS de Cheveigné, A., "Separation of concurrent harmonic sounds: Fundamental frequency estimation and a time-domain cancellation model of auditory processing", J. Acoust. Soc. Am., vol. 93, No. 6, Jun. 1993, pp. 3271-3290.

Barker, J. et al., "Speech fragment decoding techniques for simultaneous speaker identification and speech recognition", Computer Speech and Language, vol. 24, (2010) pp. 94-111. (Available online May 21, 2008).

Barker, J. et al., "Decoding Speech in the Presence of Other Sound Sources", Proceedings of the 16$^{th}$ Intl. Conf. on Spoken Language Processing, 2000 (ICSLP 2000), Beijing, China.

Cooke, M. et al., "Monaural speech separation and recognition challenge", Computer Speech and Language, vol. 24 (2010), pp. 1-15. (Available online Mar. 27, 2009).

Davy, M. et al., "Bayesian Harmonic Models for Musical Signal Analysis", Bayesian Statistics, vol. 7 (2003), pp. 1-15.

Hershey, J. et al., "Super-human multi-talker speech recognition: A graphical modeling approach", Computer Speech and Language, vol. 24 (2010), pp. 45-66. (Available online Jan. 1, 2009).

Hohmann, V., "Frequency analysis and synthesis using a Gammatone filterbank", Acta Acustica United with Acustica, vol. 88 (2002), pp. 433-442.

Hu, G. et al., "An Auditory Scene Analysis Approach to Monaural Speech Segregation", *Topics in Acoustic Echo and Noise Control*, (Springer 2006), pp. 485-515.

Hu, G. et al., "Auditory Segmentation Based on Onset and Offset Analysis", IEEE Transactions on Audio, Speech, and Language Processing, vol. 15, No. 2, Feb. 2007, pp. 396-405.

McAulay, R. et al., "Speech Analysis/Synthesis Based on a Sinusoidal Representation", IEEE Transactions on Acoustics, Speech, and Signal Processing, vol. ASSP-34, No. 4, Aug. 1986, pp. 744-754.

Smaragdis, P., "Convolutive Speech Bases and Their Application to Supervised Speech Separation", IEEE Transactions on Audio, Speech, and Language Processing, vol. 15, No. 1, Jan. 2007, pp. 1-12.

Vishnubhotla, S. et al., "An Algorithm for Speech Segregation of Co-Channel Speech", Proc. of the Intl. Conf. on Acoustics, Speech & Signal Processing, 2009 (ICASSP 2009), Taipei, Apr. 19-24, 2009, pp. 1-4.

Vishnubhotla, S. et al., "Speech Segregation from Co-channel Mixtures", Institute for Systems Research Openhouse, University of Maryland, Apr. 16, 2009, p. 1.

Quatieri, T. et al., "An Approach to Co-Channel Talker Interference Suppression Using a Sinusoidal Model for Speech", IEEE Transactions on Acoustics, Speech, and Signal Processing, vol. 38, No. 1, Jan. 1990, pp. 56-69.

Reddy, A. et al., "Soft Mask Methods for Single-Channel Speaker Separation", IEEE Transaction on Audio, Speech, and Language Processing, vol. 15, No. 6 , Aug. 2007, pp. 1766-1776.

First Office Action for Chinese Application No. 201180013528.7, dated Dec. 26, 2013.

International Search Report and Written Opinion for International Application No. PCT/US11/23226, dated Jun. 14, 2013.

Extended Search Report for European Application No. 11737836.4, dated Jun. 27, 2014.

Vishnubhotla, Srikanth et al. "An algorithm for speech segregation of co-channel speech" IEEE International Conference on Acoustic, Speech and Signal Processing, dated Apr. 19, 2009, pp. 109-112.

Hu, G. et al. "Monaural Speech Segregation Based on Pitch Tracking and Amplitude Modulation," IEEE Transactions on Neural Networks, vol. 15, No. 5, Sep. 1, 2004, pp. 1135-1150.

Gu, Y H et al. "Co-channel speech separation using frequency bin non-linear adaptive filtering," IEEE International Conference on Acoustic, Speech and Signal Processing, Apr. 14, 1991, pp. 109-112.

Second Office Action for CN Application No. 201180013528.7, dated Oct. 15, 2014.

Office Action for European Application No. 11737836.4, dated Oct. 5, 2015.

Office Action for Chinese Application No. 201180013528.7, dated Feb. 29, 2016.

Vishnubhotla S et al: "An algorithm for speech segregation of co-channel speech," Acoustics, Speech and Signal Processing, 2009. ICASSP 2009. IEEE International Conference on, IEEE, Piscataway, NJ, USA, Apr. 19, 2009, pp. 109-112.

Hu G et al: "Monaural Speech Segregation Based on Pitch Tracking and Amplitude Modulation," IEEE Transactions on Neural Networks, IEEE Service Center, Piscataway, NJ, US, vol. 15, No. 5, Sep. 1, 2004, pp. 1135-1150.

Gu Y H et al: "Co-channel speech separation using frequency bin nonlinear adaptive filtering," Speech Processing 1. Toronto, May 14- 17, 1991; [International Conference on Acoustics, Speech & Signal Processing. ICASSP], New York, IEEE, US, vol. Conf. 16, Apr. 14, 1991, pp. 949-952.

SYSTEMS AND METHODS FOR SPEECH EXTRACTION

CROSS-REFERENCE TO RELATED APPLICATIONS

This application claims priority to and is a continuation of U.S. patent application Ser. No. 13/018,064, entitled "Systems and Methods for Speech Extraction", filed Jan. 31, 2011, which claims priority to U.S. Provisional Patent Application No. 61/299,776, entitled, "Method to Separate Overlapping Speech Signals from a Speech Mixture for Use in a Segregation Algorithm," filed Jan. 29, 2010; the disclosures of each are hereby incorporated by reference in their entirety.

This application is related to U.S. patent application Ser. No. 12/889,298, entitled, "Systems and Methods for Multiple Pitch Tracking," filed Sep. 23, 2010, which claims priority to U.S. Provisional Patent Application No. 61/245,102, entitled, "System and Algorithm for Multiple Pitch Tracking in Adverse Environments," filed Sep. 23, 2009; the disclosures of each are hereby incorporated by reference in their entirety.

This application is related to U.S. Provisional Patent Application No. 61/406,318, entitled, "Sequential Grouping in Co-Channel Speech," filed Oct. 25, 2010; the disclosure of which is hereby incorporated by reference in its entirety.

STATEMENT REGARDING FEDERALLY FUNDED RESEARCH

This disclosure was made with government support under grant number IIS0812509 awarded by the National Science Foundation. The government has certain rights in the disclosure.

BACKGROUND

Some embodiments relate to speech extraction, and more particularly, to system and methods of speech extraction.

Known speech technologies (e.g., automatic speech recognition or speaker identification) typically encounter speech signals that are obscured by external factors including background noise, interfering speakers, channel distortions, etc. For example, in known communication systems (e.g., mobile phones, land line phones, other wireless technology and Voice-Over-IP technology) the speech signals being transmitted are routinely obscured by external sources of noise and interference. Similarly, users donning hearing-aids and cochlear implant devices are often plagued by external disturbances that interfere with the speech signals they are struggling to understand. These disturbances can become so overwhelming that users often prefer to turn their medical devices off and, as a result, these medical devices are useless to some users in certain situations. A speech extraction process, therefore, is needed to improve the quality of the speech signals produced by these devices (e.g., medical devices or communication devices).

Additionally, known speech extraction processes often attempt to perform the function of speech separation (e.g., separating interfering speech signals or separating background noise from speech) by relying on multiple sensors (e.g., microphones) to exploit their geometrical spacing to improve the quality of speech signals. Most of the communication systems and medical devices previously described, however, only include one sensor (or some other limited number). The known speech extraction processes, therefore, are not suitable for use with these systems or devices without expensive modification.

Thus, a need exists for an improved speech extraction process that can separate a desired speech signal from interfering speech signals or background noise using a single sensor and can also provide speech quality recovery that is better than the multi-microphone solutions.

SUMMARY

In some embodiments, a processor-readable medium stores code representing instructions to cause a processor to receive an input signal having a first component and a second component. An estimate of the first component of the input signal is calculated based on an estimate of a pitch of the first component of the input signal. An estimate of the input signal is calculated based on the estimate of the first component of the input signal and an estimate of the second component of the input signal. The estimate of the first component of the input signal is modified based on a scaling function to produce a reconstructed first component of the input signal. In some embodiments, the scaling function is a function of at least one of the input signal, the estimate of the first component of the input signal, the estimate of the second component of the input signal, or a residual signal derived from the input signal and the estimate of the input signal.

DETAILED DESCRIPTION

Figure 1:
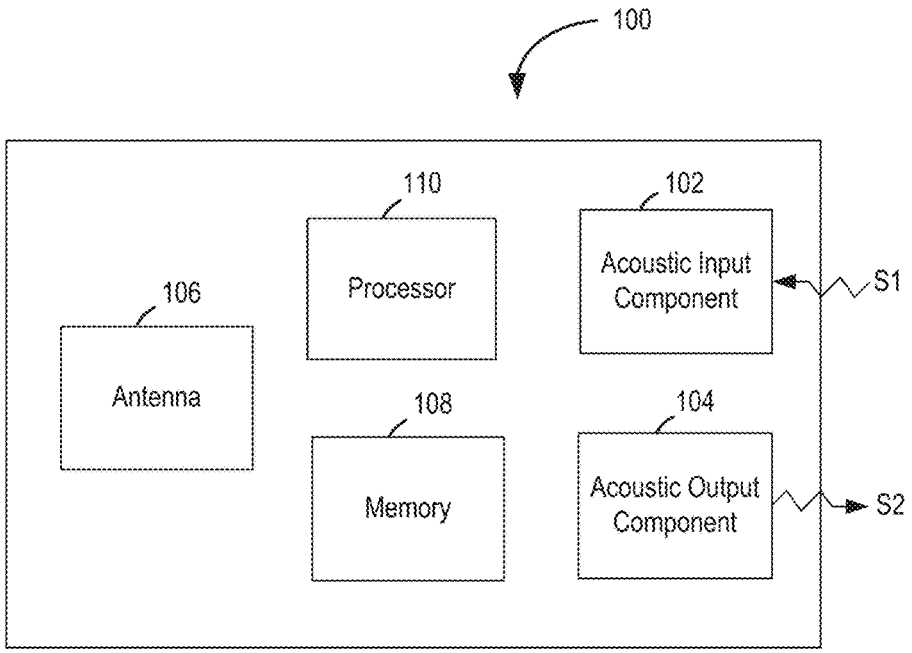
FIG. 1 is a schematic illustration of an acoustic device implementing a speech extraction system according to an embodiment.

Systems and methods for speech extraction processing are described herein. In some embodiments, the speech extraction process discussed herein is part of a software-based approach to automatically separate two signals (e.g., two speech signals) that overlap with each other. In some embodiments, the overall system within which the speech extraction process is embodied can be referred to as a "segregation system" or "segregation technology." This segregation system can have, for example, three different stages—the analysis stage, the synthesis stage, and the clustering stage. The analysis stage and the synthesis stage are described in detail herein. A detailed discussion of the clustering stage can be found in U.S. Provisional Patent Application No. 61/406,318, entitled, "Sequential Grouping in Co-Channel Speech," filed Oct. 25, 2010, the disclosure of which is hereby incorporated by reference in its entirety. The analysis stage, the synthesis stage and the clustering stage are respectively referred to herein as or embodied as the "analysis module," the "synthesis module," and the "clustering module."

The terms "speech extraction" and "speech segregation" are synonymous for purposes of this description and may be used interchangeably unless otherwise specified.

The word "component" as used herein refers to a signal or a portion of a signal, unless otherwise stated. A component can be related to speech, music, noise (stationary, or non-stationary), or any other sound. In general, speech includes a voiced component and, in some embodiments, also includes an unvoiced component (or other non-speech component). A component can be periodic, substantially periodic, quasi-periodic, substantially aperiodic or aperiodic. For example, a voiced component (e.g., a "speech component") is periodic, substantially periodic or quasi-periodic. Other components that do not include speech (i.e., a "non-speech component") can also be periodic, substantially periodic or quasi-periodic. A non-speech component can be, for example, sounds from the environment (e.g., a siren) that exhibit periodic, substantially periodic or quasi-periodic characteristics. An unvoiced component, however, is aperiodic or substantially aperiodic (e.g., the sound "sh" or any other aperiodic noise). An unvoiced component can contain speech (e.g., the sound "sh") but that speech is aperiodic or substantially aperiodic. Other components that do not include speech and are aperiodic or substantially aperiodic can include, for example, background noise. A substantially periodic component can, for example, refer to a signal that, when graphically represented in the time domain, exhibits a repeating pattern. A substantially aperiodic component can, for example, refer to a signal that, when graphically represented in the time domain, does not exhibit a repeating pattern.

The term "periodic component" as used herein refers to any component that is periodic, substantially periodic or quasi-periodic. A periodic component can therefore be a voiced component (or a speech component) and/or a non-speech component. The term "non-periodic component" as used herein refers to any component that is aperiodic or substantially aperiodic. An aperiodic component can therefore be a synonymous and interchangeable with the term "unvoiced component" defined above.

FIG. 1 is a schematic illustration of an audio device 100 that includes an implementation of a speech extraction process. For purposes of this embodiment, the audio device 100 is described as operating in a manner similar to a cell phone. It should be understood, however, that the audio device 100 can be any suitable audio device for storing and/or using the speech extraction process or any other process described herein. For example, in some embodiments, the audio device 100 can be a personal digital assistant (PDA), a medical device (e.g., a hearing aid or cochlear implant), a recording or acquisition device (e.g., a voice recorder), a storage device (e.g., a memory storing files with audio content), a computer (e.g., a supercomputer or a mainframe computer) and/or the like.

The audio device 100 includes an acoustic input component 102, an acoustic output component 104, an antenna 106, a memory 108, and a processor 110. Any one of these components can be arranged within (or at least partially within) the audio device 100 in any suitable configuration. Additionally, any one of these components can be connected to another component in any suitable manner (e.g., electrically interconnected via wires or soldering to a circuit board, a communication bus, etc.).

The acoustic input component 102, the acoustic output component 104, and the antenna 106 can operate, for example, in a manner similar to any acoustic input component, acoustic output component and antenna found within a cell phone. For example, the acoustic input component 102 can be a microphone, which can receive sound waves and then convert those sound waves into electrical signals for use by the processor 110. The acoustic output component 104 can be a speaker, which is configured to receive electrical signals from the processor 110 and output those electrical signals as sound waves. Further, the antenna 106 is configured to communicate with, for example, a cell repeater or mobile base station. In embodiments where the audio device 100 is not a cell phone, the audio device 100 may or may not include any one of the acoustic input component 102, the acoustic output component 104, and/or the antenna 106.

The memory 108 can be any suitable memory configured to fit within or operate with the audio device 100 (e.g., a cell phone), such as, for example, a read-only memory (ROM), a random access memory (RAM), a flash memory, and/or the like. In some embodiments, the memory 108 is removable from the device 100. In some embodiments, the memory 108 can include a database.

The processor 110 is configured to implement the speech extraction process for the audio device 100. In some embodiments, the processor 110 stores software implementing the process within its memory architecture (not illustrated). The processor 110 can be any suitable processor that fits within or operates with the audio device 100 and its components. For example, the processor 110 can be a general purpose processor (e.g., a digital signal processor (DSP)) that executes software stored in memory; in other embodiments, the process can be implemented within hardware, such as a field programmable gate array (FPGA), or application-specific integrated circuit (ASIC). In some embodiments, the audio device 100 does not include the processor 110. In other embodiments, the functions of the processor can be allocated to a general purpose processor and, for example, a DSP.

In use, the acoustic input component 102 of the audio device 100 receives sound waves S1 from its surrounding environment. These sound waves S1 can include the speech (i.e., voice) of the user talking into the audio device 100 as well as any background noises. For example, in instances where the user is walking outside along a busy street, the acoustic input component 102 can detect sounds from sirens, car horns, or people shouting or conversing, in addition to detecting the user's voice. The acoustic input component 102 converts these sound waves S1 into electrical signals, which are then sent to the processor 110 for processing. The processor 110 executes the software, which implements the speech extraction process. The speech extraction process can analyze the electrical signals in any one of the manners described below (see, for example, FIG. 4). The electrical signals are then filtered based on the results of the speech extraction process so that the undesired sounds (e.g., other speakers, background noise) are substantially removed from the signals (or attenuated) and the remaining signals represent a more intelligible version of or are a closer match to the user's speech (see, for example, FIGS. 15A, 15B and 15C).

In some embodiments, the audio device 100 can filter signals received via the antenna 106 (e.g., from a different audio device) using the speech extraction process. For example, in embodiments where the received signal includes speech as well as undesired sounds (e.g., distracting background noise or another speakers voice), the audio device 100 can use the process to filter the received signal and then output the sound waves S2 of the filtered signal via the acoustic output component 104. As a result, the user of the audio device 100 can hear the voice of a distant speaker with minimal to no background noise or interference from another speaker.

In some embodiments, the speech extraction process (or any sub-process thereof) can be incorporated into the audio device 100 via the processor 110 and/or memory 108 without any additional hardware requirements. For example, in some embodiments, the speech extraction process (or any sub-process thereof) is pre-programmed within the audio device 100 (i.e., the processor 110 and/or memory 108) prior to the audio device 100 being distributed in commerce. In other embodiments, a software version of the speech extraction process (or any sub-process thereof) stored in the memory 108 can be downloaded to the audio device 100 through occasional, routine or periodic software updates after the audio device 100 has been purchased. In yet other embodiments, a software version of the speech extraction process (or any sub-process thereof) can be available for purchase from a provider (e.g., a cell phone provider) and, upon purchase of the software, can be downloaded to the audio device 100.

Figure 2:
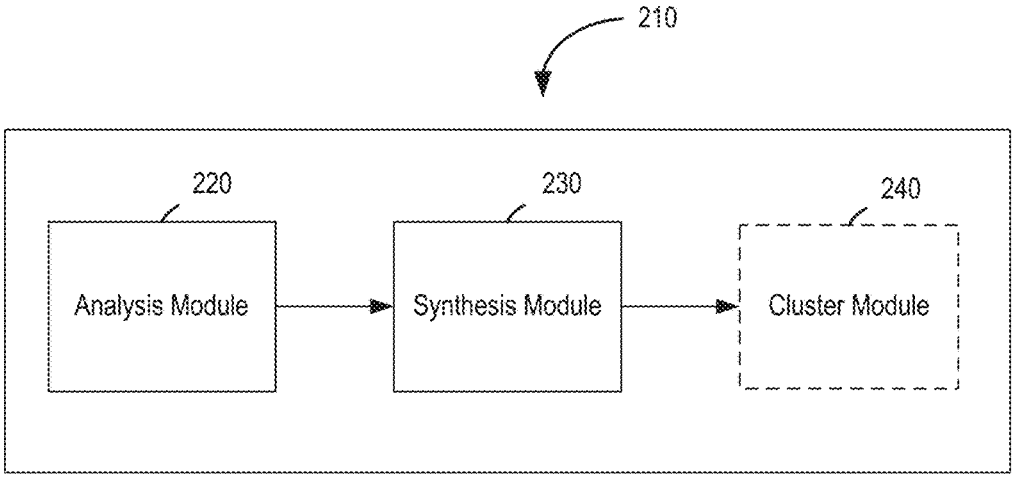
FIG. 2 is a schematic illustration of a processor according to an embodiment.

In some embodiments, the processor 110 includes one or more modules (e.g., a module of computer code to be executed in hardware, or a set of processor-readable instructions stored in memory and to be executed in hardware) that execute the speech extraction process. For example, FIG. 2 is a schematic illustration of a processor 210 (e.g., a DSP or other processor) having an analysis module 220, a synthesis module 230 and, optionally, a cluster module 240, to execute a speech extraction process, according to an embodiment. The processor 210 can be integrated into or included in any suitable audio device, such as, for example, the audio devices described above with reference to FIG. 1. In some embodiments, the processor 210 is an off-the-shelf product that can be programmed to include the analysis module 220, the synthesis module 230 and/or the cluster module 240 and then added to the audio device after manufacturing (e.g., software stored in memory and executed in hardware). In other embodiments, the processor 210 is incorporated into the audio device at the time of manufacturing (e.g., software stored in memory and executed in hardware, or implemented in hardware). In such embodiments, the analysis module 220, the synthesis module 230 and/or the cluster module 240 can either be programmed into the audio device at the time of manufacturing or downloaded into the audio device after manufacturing.

In use, the processor 210 receives an input signal (shown in FIG. 3) from the audio device within which the processor 210 is integrated (see, for example, audio device 100 in FIG. 1). For purposes of simplicity, the input signal is described herein as having no more than two components at any given time, and at some instances of time may have zero components (e.g., silence). For example, in some embodiments, the input signal can have two periodic components (e.g., two voiced components from two different speakers) during a first time period, one component during a second time period, and zero components during a third time period. Although this example is discussed with no more than two components, it should be understood that the input signal can have any number of components at any given time.

The input signal is first processed by the analysis module 220. The analysis module 220 can analyze the input signal and then, based on its analysis, estimate the portion of the input signal that corresponds to the various components of the input signal. For example, in embodiments where the input signal has two periodic components (e.g., two voiced components), the analysis module 220 can estimate the portion of the input signal that corresponds to a first periodic component (e.g., an "estimated first component") as well as estimate the portion of the input signal that corresponds to a second periodic component (e.g., an "estimated second component"). The analysis module 220 can then segregate the estimated first component and the estimated second component from the input signal, as discussed in more detail herein. For example, the analysis module 220 can use the estimates to segregate the first periodic component from the second periodic component; or, more particularly, the analysis module 220 can use the estimates to segregate an estimate of the first periodic component from an estimate of the second periodic component. The analysis module 220 can segregate the components of the input signal in any one of the manners described below (see, for example, FIG. 9 and the related discussion). In some embodiments, the analysis module 220 can normalize the input signal and/or filter the input signal prior to the estimation and/or segregation processes performed by the analysis module 220.

The synthesis module 230 receives each of the estimated components segregated from the input signal (e.g., the estimated first component and the estimated second component) from the analysis module 220. The synthesis module 230 can evaluate these estimated components and determine if the analysis module's 220 estimation of the components of the input signal are reliable. Said another way, the synthesis module 230 can operate, at least in part, to "double check" the results generated by the analysis module 220. The synthesis module 230 can evaluate the estimated components segregated from the input signal in any one of the manners described below (see, for example, FIG. 10 and the related discussion).

Once the reliability of the estimated components are determined, the synthesis module 230 can use the estimated components to reconstruct the individual speech signals that correspond to the actual components of the input signal, as discussed in more detail herein, to produce a reconstructed speech signal. The synthesis module 230 can reconstruct the individual speech signals in any one of the manners described below (see, for example, FIG. 11 and the related discussion). In some embodiments, the synthesis module 230 is configured to scale the estimated components to a certain degree and then use the scaled estimated components to reconstruct the individual speech signals.

In some embodiments, the synthesis module 230 can send the reconstructed speech signal (or the extracted/segregated estimated component) to, for example, an antenna (e.g., antenna 106) of the device (e.g., device 100) within which the processor 210 is implemented, such that the reconstructed speech signal (or the extracted/segregated estimated component) is transmitted to another device where the reconstructed speech signal (or the extracted/segregated estimated component) can be heard without interference from the remaining components of the input signal.

Returning to FIG. 2, in some embodiments, the synthesis module 230 can send the reconstructed speech signal (or the extracted/segregated estimated component) to the cluster module 240. The cluster module 240 can analyze the reconstructed speech signals and then assign each reconstructed speech signal to an appropriate speaker. The operation and functionality of the cluster module 240 is not discussed in detail herein, but is described in U.S. Provisional Patent Application No. 61/406,318, which is incorporated by reference above.

Figure 3:
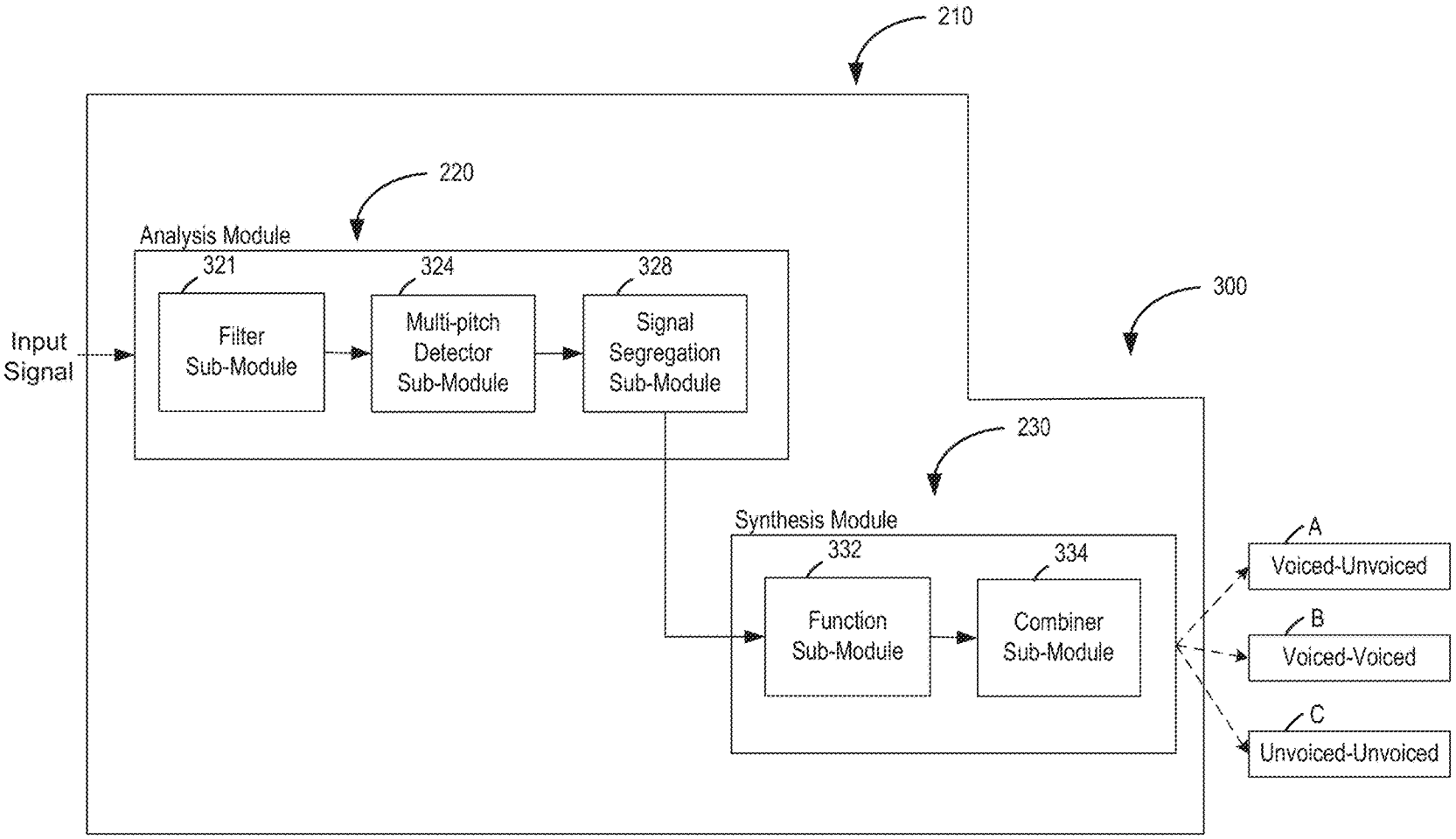
FIG. 3 is a schematic illustration of a speech extraction system according to an embodiment.

In some embodiments, the analysis module 220 and the synthesis module 230 can be implemented via one or more sub-modules having one or more specific processes. FIG. 3, for example, is a schematic illustration of an embodiment where the analysis module 220 and the synthesis module 230 are implemented via one or more sub-modules. The analysis module 220 can be implemented, at least in part, via a filter sub-module 321, a multi-pitch detector sub-module 324 and a signal segregation sub-module 328. The analysis module 220, for example, can filter an input signal via the filter sub-module 321, estimate a pitch of one or more components of the filtered input signal via the multi-pitch detector sub-module 324, and then segregate those one or more components from the filtered input signal based on their respective estimated pitches via the signal segregation sub-module 328.

More specifically, the filter sub-module 321 is configured to filter an input signal received from an audio device. The input signal can be filtered, for example, so that the input signal is decomposed into a number of time units (or "frames") and frequency units (or "channels"). A detailed description of the filtering process is discussed with reference to FIG. 6. In some embodiments, the filter sub-module 321 is configured to normalize the input signal before the input signal is filtered (see, for example, FIGS. 4 and 5 and the related discussions). In some embodiments, the filter sub-module 321 is configured to identify those units of the filtered input signal that are silent or have sound (e.g., decibel level) that fall below a certain threshold level. In some such embodiments, as will be described in more detail herein, the filter sub-module 321 operatively prevents the identified "silent" units from continuing through the speech extraction process. In this manner, only units from the filtered signal that have appreciable sound are allowed to proceed through the speech extraction process.

In some instances, filtering the input signal via the filter sub-module 321 before that input signal is analyzed by either the remaining sub-modules of the analysis module 220 or the synthesis module 230 may increase the efficiency and/or effectiveness of the analysis. In some embodiments, however, the input signal is not filtered before it is analyzed. In some such embodiments, the analysis module 220 may not include a filter sub-module 321.

Once the input signal is filtered, the multi-pitch detector sub-module 324 can analyze the filtered input signal and estimate a pitch (if any) for each of the components of the filtered input signal. The multi-pitch detector sub-module 324 can analyze the filtered input signal using, for example, AMDF or ACF methods, which are described in U.S. patent application Ser. No. 12/889,298, entitled, "Systems and Methods for Multiple Pitch Tracking," filed Sep. 23, 2010, the disclosure of which is incorporated by reference in its entirety. The multi-pitch detector sub-module 324 can also estimate any number of pitches from the filtered input signal using any one of the methods discussed in the above-mentioned U.S. patent application Ser. No. 12/889,298.

It should be understood that, before this point in the speech extraction process, the various components of the input signal were unknown—e.g., it was unknown whether the input signal contained one periodic component, two periodic components, zero periodic components and/or unvoiced components. The multi-pitch detector sub-module 324, however, can estimate how many periodic components are contained within the input signal by identifying one or more pitches present within the input signal. Therefore, from this point forward in the speech extraction process, it can be assumed (for simplicity) that if the multi-pitch detector sub-module 324 detects a pitch, that detected pitch corresponds to a periodic component of the input signal and, more particularly, to a voiced component. Therefore, for purposes of this discussion, if one pitch is detected, the input signal presumably contains one speech component; if two pitches are detected, the input signal presumably contains two speech components, and so on. In reality, however, the multi-pitch detector sub-module 324 can also detect a pitch for a non-speech component contained within the input signal. The non-speech component is processed within the analysis module 220 in the same manner as the speech component. As such, it may be possible for the speech extraction process to separate speech components from non-speech components.

Once the multi-pitch detector 324 estimates one or more pitches from the input signal, the multi-pitch detector sub-module 324 outputs that pitch estimate to the next sub-module or block in the speech extraction process. For example, in embodiments where the input signal has two periodic components (e.g., the two voiced components, as discussed above), the multi-pitch detector sub-module 324 outputs a pitch estimate for the first voiced component (e.g., 6.7 msec corresponding to a pitch period of 150 Hz) and another pitch estimate for the second voiced component (e.g., 5.4 msec corresponding to a pitch period of 186 Hz).

The signal segregation sub-module 328 can use the pitch estimates from the multi-pitch detector sub-module 324 to estimate the components of the input signal and can then segregate those estimated components of the input signal from the remaining components (or portions) of the input signal. For example, assuming that a pitch estimate corresponds to a pitch of a first voiced component, the signal segregation sub-module 328 can use the pitch estimate to estimate the portion of the input signal that corresponds to that first voiced component. To reiterate, the first periodic component (i.e., the first voiced component) that is extracted from the input signal by the signal segregation sub-module 328 is merely an estimation of the actual component of the input signal—at this point during the process, the actual component of the input signal is unknown. The signal segregation sub-module 328, however, can estimate the components of the input signal based on the pitches estimated by the multi-pitch detector sub-module 324. In some instances, as will be discussed, the estimated component that the signal segregation sub-module 328 extracts from the input signal may not match up exactly with the actual component of the input signal because the estimated component is itself derived from an estimated value—i.e., the estimated pitch. The signal segregation sub-module 328 can use any of the segregation process techniques discussed herein (see, for example, FIG. 9 and related discussions).

Once the input signal is processed by the analysis module 220 and the sub-modules 321, 324 and/or 328 therein, the input signal is further processed by the synthesis module 230. The synthesis module 230 can be implemented, at least in part, via a function sub-module 332 and a combiner sub-module 334. The function sub-module 332 receives the estimated components of the input signal from the signal segregation sub-module 328 of the analysis module 220 and can then determine the "reliability" of those estimated components. For example, the function sub-module 332, through various calculations, can determine whether those estimated components of the input signal should be used to reconstruct the input signal. In some embodiments, the function sub-module 332 operates as a switch that only allows an estimated component to proceed in the process (e.g., for reconstruction) when one or more parameters (e.g., power level) of that estimated component exceed a certain threshold value (see, for example, FIG. 10 and related discussions). In some embodiments, however, the function sub-module 332 modifies (e.g., scales) each estimated component based on one or more factors such that each of the estimated components (in their modified form) are allowed to proceed in the process (see, for example, FIG. 11 and related discussions). The function sub-module 332 can evaluate the estimated components to determine their reliability in any one of the manners discussed herein.

The combiner sub-module 334 receives the estimated components (modified or otherwise) that are output from the function sub-module 332 and can then filter those estimated components. In embodiments where the input signal was decomposed into units by the filter sub-module 321 in the analysis module 220, the combiner sub-module 334 can combine the units to recompose or reconstruct the input signal (or at least a portion of the input signal corresponding to the estimated component). More particularly, the combiner sub-module 334 can construct a signal that resembles the input signal by combining the estimated components of each unit. The combiner sub-module 334 can filter the output of the function sub-module 332 in any one of the manners discussed herein (see, for example, FIG. 13 and related discussions). In some embodiments, the synthesis module 230 does not include the combiner sub-module 334.

As shown in FIG. 3, the output of the synthesis module 230 is a representation of the input signal with voiced components separated from unvoiced components (A), voiced components separated from other voiced components (B), or unvoiced components separated from other unvoiced components (C). More broadly stated, the synthesis module 230 can separate a periodic component from a non-periodic component (A), a periodic component from another periodic component (B), or a non-periodic component from another non-periodic component (C).

In some embodiments, the software includes a cluster module (e.g., cluster module 240) that can evaluate the reconstructed input signal and assign a speaker or label to each component of the input signal. In some embodiments, the cluster module is not a stand-alone module but rather is a sub-module of the synthesis module 230.

FIGS. 1-3 provide an overview of the types of devices, components and modules that can be used to implement the speech extraction process. The remaining figures illustrate and describe the speech extraction process and its processes in greater detail. It should be understood that the following processes and methods can be implemented in any hardware-based module(s) (e.g., a DSP) or any software-based module(s) executed in hardware in any of the manners discussed above with respect to FIGS. 1-3, unless otherwise specified.

Figure 4:
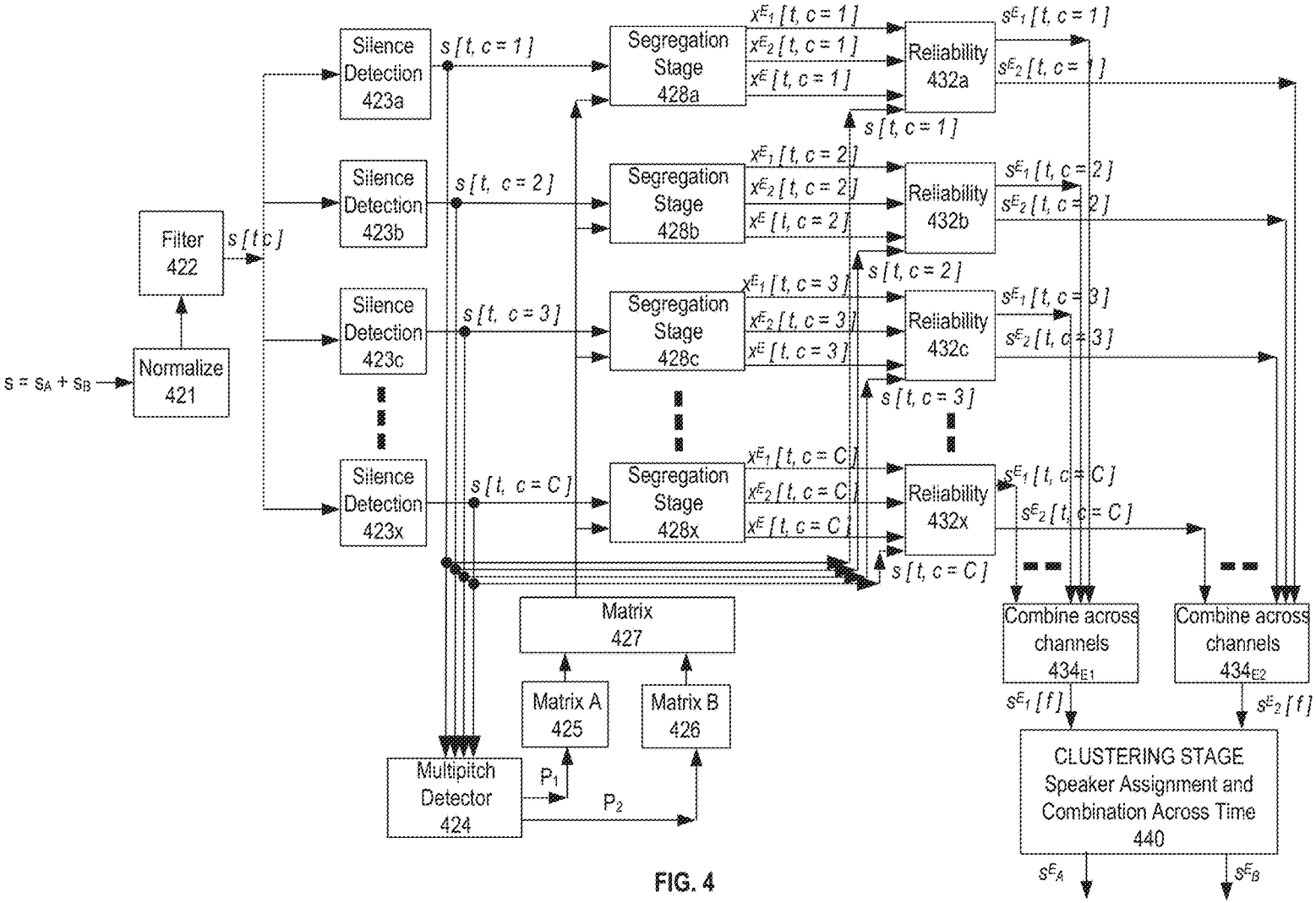
FIG. 4 is a block diagram of a speech extraction system according to another embodiment.

FIG. 4 is a block diagram of a speech extraction process 400 for processing an input signal s. The speech extraction process can be implemented on a processor (e.g., processor 210) executing software stored in memory or can be integrated into hardware, as discussed above. The speech extraction process includes multiple blocks with various interconnectivities. Each block is configured to perform a particular function of the speech extraction process.

The speech extraction process begins by receiving the input signal s from an audio device. The input signal s can have any number of components, as discussed above. In this particular instance, the input signal s includes two periodic signal components—$s_A$ and $s_B$—which are voiced components that represent a first speaker's voice (A) and a second speaker's voice (B), respectively. In some embodiments, however, only the one of the components (e.g., component $s_A$) is a voiced component; the other component (e.g., component $s_B$) can be a non-speech component such as, for example, a siren. In yet other embodiments, one of the components can be a non-periodic component containing, for example, background noise. Although the input signal s is described with respect to FIG. 4 as having two voiced, speech components $s_A$ and $s_B$, the input signal s can also include one or more other periodic components or non-periodic components (e.g., components sc and/or $s_D$), which can be processed in the same manner as voiced, speech components $s_A$ and $s_B$. The input signal s can be, for example, derived from one speaker (A or B) talking into a microphone and the other speaker (A or B) talking in the background. Alternatively, the other speaker's voice (A or B) can be intended to be heard (e.g., two or more speakers talking into the same microphone). The speakers' collective voices are considered the input signal s for purposes of this discussion. In other embodiments, the input signal s can be derived from two speakers (A and B) having a conversation with each other using different devices and speaking into different microphones (e.g., a recorded telephone conversation). In yet other embodiments, the input signal s can be derived from music (e.g., recorded music being played back on an audio device).

Figure 5:
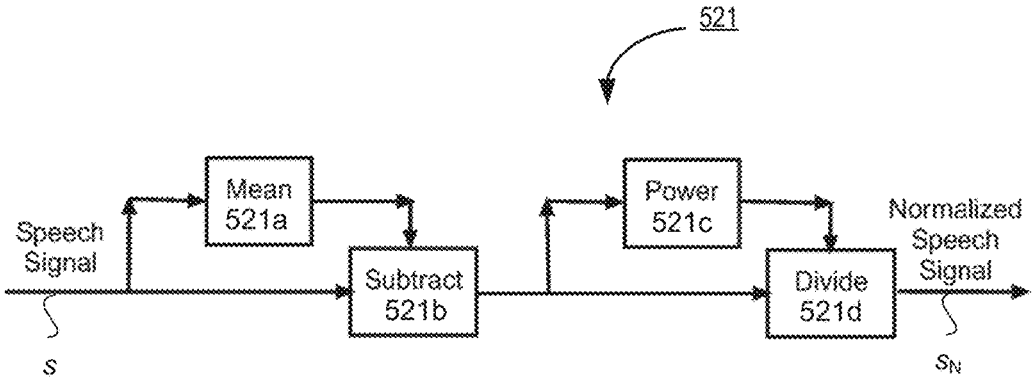
FIG. 5 is a schematic illustration of a normalization sub-module of a speech extraction system according to an embodiment.

At the outset of the speech extraction process, the input signal s is passed to block 421 (labeled "normalize") for normalization. The input signal s can be normalized in any manner and according to any desired criteria. For example, in some embodiments, the input signal s can be normalized to have unit variance and/or zero mean. FIG. 5 describes one particular technique that the block 421 can use to normalize the input signal s, as discussed in more detail below. In some embodiments, however, the speech extraction process does not normalize the input signal s and, therefore, does not include block 421.

Figure 6:
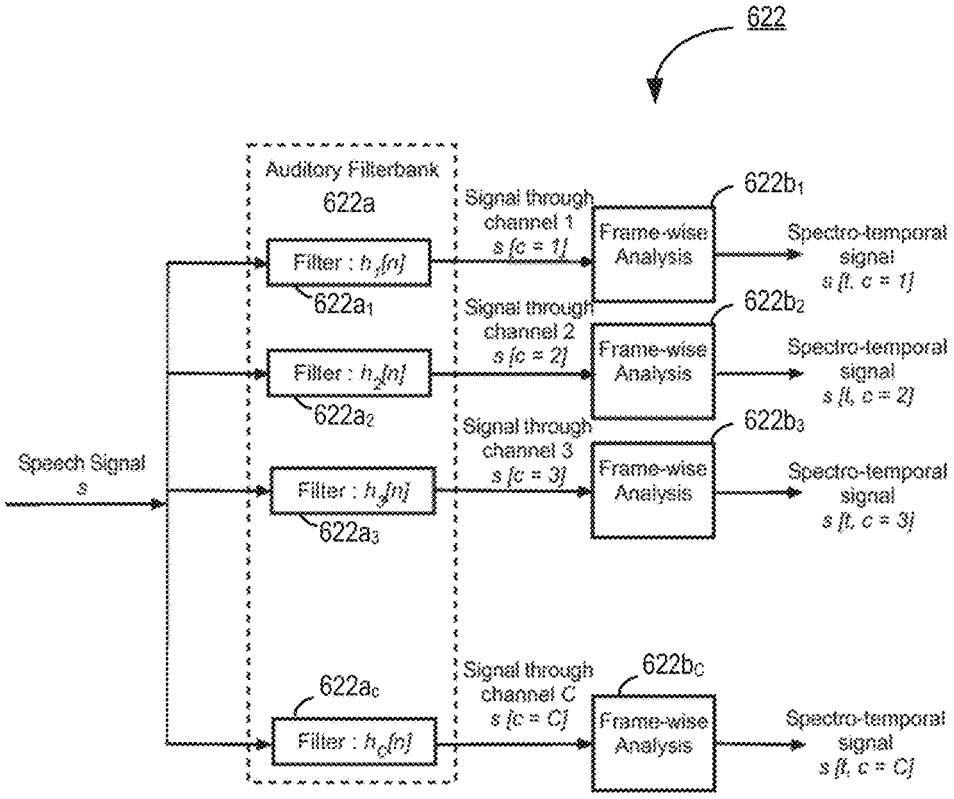
FIG. 6 is a schematic illustration of a spectro-temporal decomposition sub-module of a speech extraction system according to an embodiment.

Returning to FIG. 4, the normalized input signal (e.g., "$s_N$") is then passed to block 422 for filtering. In embodiments where the input signal s is not normalized before being passed to block 422 (e.g., where optional block 421 is not present), the input signal s is processed at block 422 as-is. As shown in FIG. 4, the block 422 splits the normalized input signal into a set of channels (each channel being assigned with a different frequency band). The normalized input signal can be split up into any number of channels, as will be discussed in more detail herein. In some embodiments, the normalized input signal can be filtered at block 422 using, for example, a filter bank that splits the input signal into the set of channels. Additionally, the block 422 can sample the normalized input signal to form multiple time-frequency (T-F) units for each channel. More specifically, the block 422 can decompose the normalized input signal into a number of time units (frames) and frequency units (channels). The resulting T-F units are defined as s[t,c], where t is time and c is the channel (e.g., c=1, 2, 3). In some embodiments, the block 422 includes one or more spectro-temporal filters that filter the normalized input signal into the T-F units. FIG. 6 describes one particular technique that block 422 can use to filter the normalized input signal into T-F units as discussed in more detail below.

Figure 7:
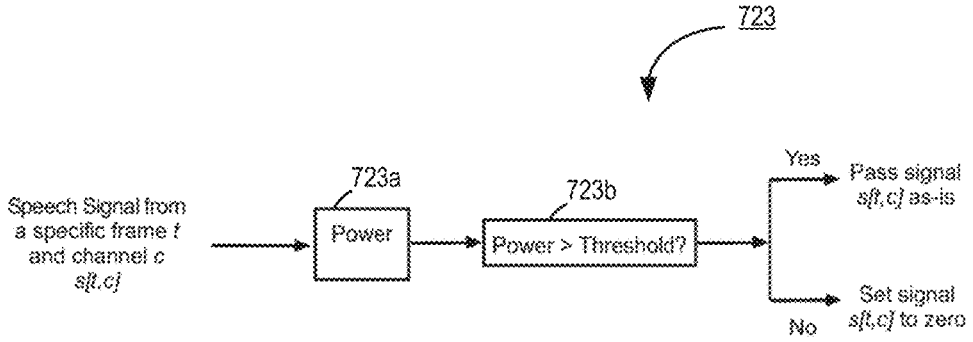
FIG. 7 is a schematic illustration of a silence detection sub-module of a speech extraction system according to an embodiment.

As shown in FIG. 4, each channel includes a silence detection block 423 configured to process each of the T-F units within that channel to determine whether they are silent or non-silent. The first channel (c=1), for example, includes the block 423*a*, which processes the T-F units (e.g., s[t,c=1]) corresponding to the first channel; the second channel (c=2) includes the block 423*b*, which processes the T-F units (e.g., s[t,c=2]) corresponding to the second channel, and so on. The T-F units that are considered silent are extracted and/or discarded at block 423*a* so that no further processing is performed on those T-F units. FIG. 7 describes one particular technique that blocks 423*a*, 423*b*, 423*c* to 423*x* can use to process the T-F units for silence detection as discussed in more detail below.

Returning to FIG. 4, in general, silence detection can increase signal processing efficiency by preventing any unnecessary processing from occurring on the T-F units that are void of any relevant data (e.g. speech components). The remaining T-F units, which are considered non-silent, are further processed as follows. In some embodiments, the block 423*a* (and/or blocks 423*b*, 423*c* to 423*x*) is optional and the speech extraction process does not include silence detection. As such, all of the T-F units, regardless of whether they are silent or non-silent, are processed as follows.

As shown in FIG. 4, the non-silent T-F units (regardless of the channel within which they are assigned) are passed to a multi-pitch detector block 424. The non-silent T-F units are also passed to a corresponding segregation block (e.g., block 428*a*) and a corresponding reliability block (e.g., block 432*a*) in accordance with their channel affiliation. At the multi-pitch detector block 424, the non-silent T-F units from all channels are evaluated and the constituent pitch frequencies $P_1$ and $P_2$ are estimated. Although the description of FIG. 4 limits the number of pitch estimates to two ($P_1$ and $P_2$), it should be understood that the multi-pitch detector block 424 can estimate any number of pitch frequencies (based on the number of periodic components present in the input signal s). The pitch estimates $P_1$ or $P_2$ can be a non-zero value or zero. The multi-pitch detector block 424 can calculate the pitch estimates $P_1$ or $P_2$ using any suitable method such as, for example, a method that incorporates an average magnitude difference function (AMDF) algorithm or an autocorrelation function (ACF) algorithm as discussed in U.S. patent application Ser. No. 12/889,298, which is incorporated by reference.

Note that at this point in the speech extraction process, it is unknown whether the pitch frequency $P_1$ belongs to speaker A or speaker B. Similarly, it is unknown whether the pitch frequency $P_2$ belongs to speaker A or B. Neither of the pitch frequencies $P_1$ or $P_2$ can be correlated to the first periodic component $s_A$ or the second periodic component $s_B$ at this point in the speech extraction process.

Figure 8:
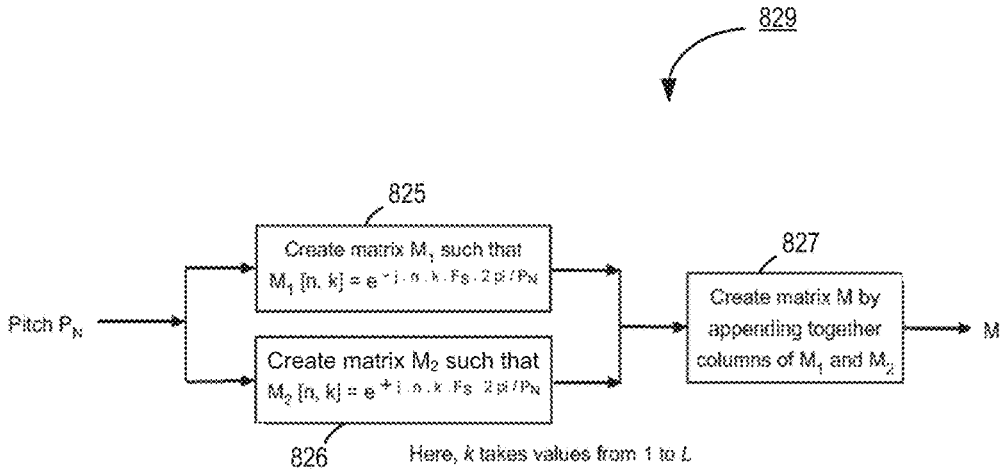
FIG. 8 is a schematic illustration of a matrix sub-module of a speech extraction system according to an embodiment.

The pitch estimates $P_1$ and $P_2$ are passed to blocks 425 and 426, respectively. In an alternative embodiment, for example the embodiment shown in FIGS. 14A and 14B, the pitch estimates $P_1$ and $P_2$ are additionally passed to scale function blocks and are used to test the reliability of an estimated signal component, as described in more detail below. Returning to FIG. 4, at block 425, the first pitch estimate $P_1$ is used to form a first matrix $V_1$. The number of columns in the first matrix $V_1$ is equal to the ratio of the sampling rate $F_s$ (of the T-F units) to the first pitch estimate $P_1$. This ratio is herein referred to simply as "F". At block 426, the second pitch estimate $P_2$ is used to form a second matrix $V_2$. From here, the first matrix $V_1$, the second matrix $V_2$ and the ratio F are passed to block 427. The first matrix $V_1$ and the second matrix $V_2$ are appended together to form a single matrix V at block 427. FIG. 8 describes one particular technique that blocks 425, 426 and/or 427 can use to form matrices $V_1$, $V_2$, and V, respectively, as described in more detail below.

The matrix V formed at block 427 and the ratio F are passed to each segregation block 428 of the various channels shown in FIG. 4. As previously discussed, the non-silent T-F units are also passed to a segregation block 428 within their respective channels. For example, the segregation block 428*a* in the first channel (c=1) receives the non-silent T-F units from the silence detection block 423*a* in the first channel and also receives the matrix V and the ratio F from block 427. At block 428*a*, the first component $s_A$ and the second component $s_B$ are estimated using the data received from block 423*a* (namely s[t,c=1]) and block 427 (namely V). More specifically, the block 428*a* produces a first signal $x^E_1$[t,c=1](i.e., an estimate corresponding to the first pitch estimate $P_1$ within channel c=1) and a second signal $x^E_2$[t, c=1] (i.e., an estimate corresponding to the second pitch estimate $P_2$ within channel c=1). It is still unknown at this point, however, which speaker (A or B) can be attributed to the pitch estimates $P_1$ and $P_2$.

Figure 9:
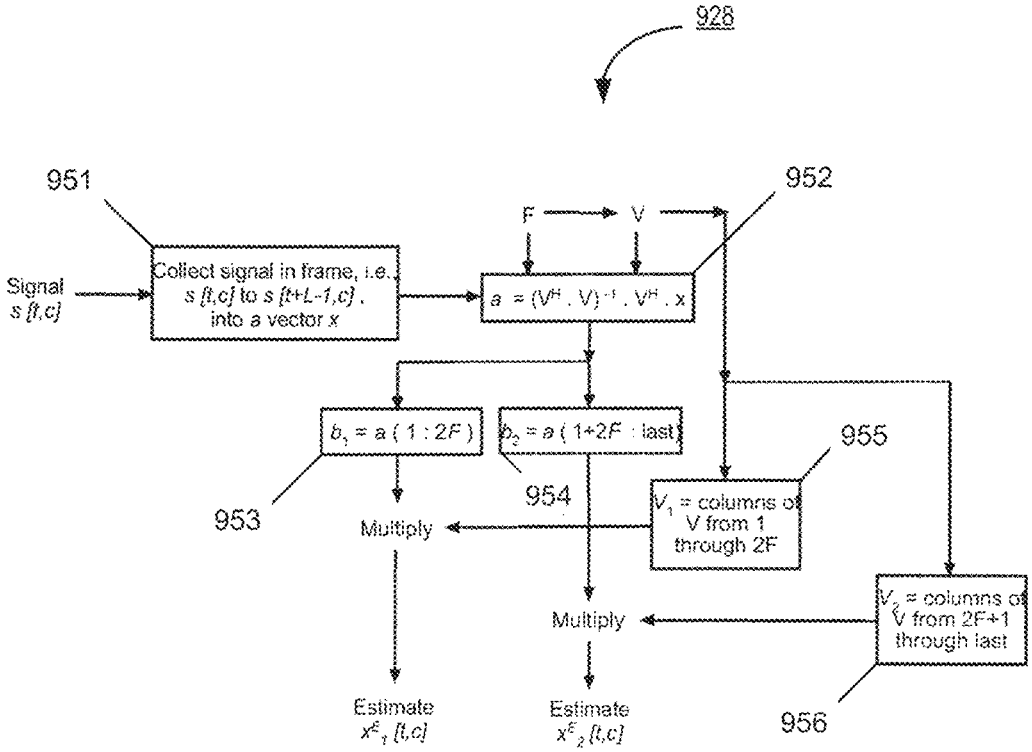
FIG. 9 is a schematic illustration of a signal segregation sub-module of a speech extraction system according to an embodiment.

The block 428*a* can further produce a third signal $x^E$[t, c=1], which is an estimate corresponding to the total input signal s[t,c]. The third signal $x^E$[t,c=1] can be calculated at block 428*a* by adding the first signal $x^E_1$[t,c=1] to the second signal $x^E_2$[t,c=1]. The first signal $x^E_1$[t,c=1], the second signal $x^E_2$[t,c=1], and/or the third signal $x^E$[t,c=1] can be calculated at block 428*a* in any suitable manner. In an alternative embodiment, for example the embodiment shown in FIGS. 14A and 14B, block 428*a* does not produce the third signal $x^E$[t,c=1]. FIG. 9 describes one particular technique that block 428*a* can use to calculate these estimated signals, as discussed in more detail below. Returning to FIG. 4, blocks 428*b* and 428*c* to 428*x* function in a manner similar to 428*a*.

The processes and the blocks described above can be, for example, implemented in an analysis module. The analysis module, which can also be referred to as an analysis stage of the speech extraction process, is therefore configured to perform the functions described above with respect to each block. In some embodiments, each block can operate as a sub-module of the analysis module. The estimated signals output from the segregation blocks (e.g., the last blocks 428 of the analysis module) can be passed, for example, to another module—the synthesis module—for further processing. The synthesis module can perform the functions and processes of, for example, blocks 432 and 434, as follows. Additionally, an alternative synthesis module is illustrated and described with respect to FIG. 14B.

As shown in FIG. 4, the three signals produced at block 428*a* (i.e., $x^E_1[t,c=1]$, $x^E_2[t,c=1]$ and $x^E[t,c=1]$) are passed to block 432*a* for further processing. Block 432*a* also receives the non-silent T-F units from the silence detection block 423*a*, as discussed above. Each reliability block within a given channel, therefore, receives four inputs—the first estimated signal $x^E_1[t,c]$, the second estimated signal $x^E_2[t,c]$, the third estimated signal $x^E[t,c]$ and the non-silent T-F units s[t,c]. In some embodiments, such as the embodiments shown in FIGS. 14A and 14B, block 428*a* only produces the first estimated signal $x^E_1[t,c=1]$ and the second estimated signal $x^E_2[t,c=1]$. Therefore, only the first estimated signal $x^E_1[t,c=1]$ and the second estimated signal $x^E_2[t,c=1]$ are passed to block 432*a* for further processing. Additionally, the pitch estimates $P_1$ and $P_2$ derived at the multi-pitch detector block 424 can be passed to block 432*a* for use in a scaling function, as discussed in more detail with respect to FIG. 14B.

Figure 10:
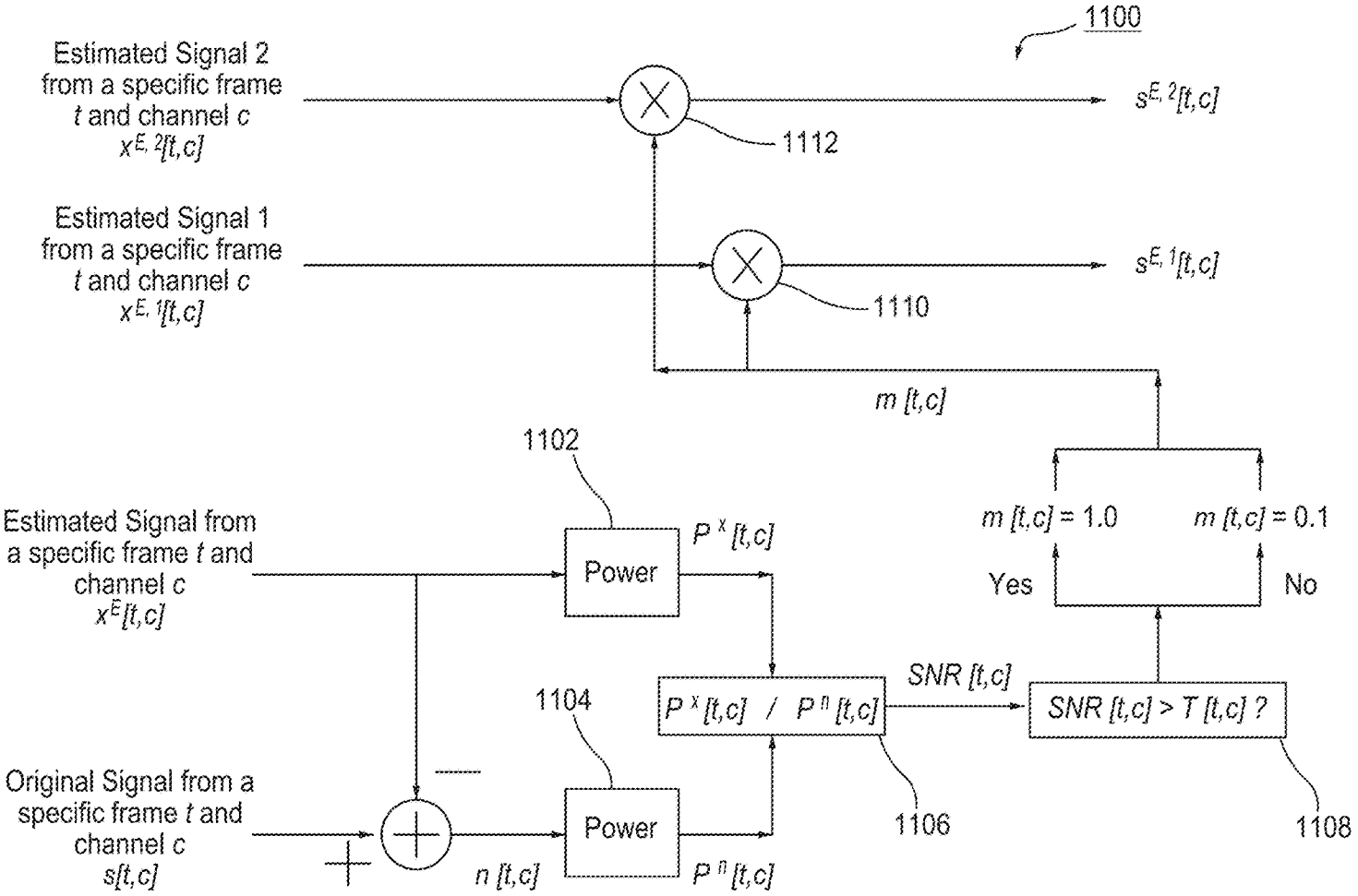
FIG. 10 is a schematic illustration of a reliability sub-module of a speech extraction system according to an embodiment.

Returning to FIG. 4, the block 432 is configured to examine the "reliability" of the first estimated signal $x^E_1[t,c]$ and the second estimated signal $x^E_2[t,c]$. The reliability of the first estimated signal $x^E_1[t,c]$ and/or the second estimated signal $x^E_2[t,c]$ can be based, for example, on one or more of the non-silent T-F units received at the block 432. The reliability of any one of the estimated signals $x^E_1[t,c]$ or $x^E_2[t,c]$, however, can be based on any suitable set of criteria or values. The reliability test can be performed in any suitable manner. FIG. 10 describes a first technique that block 432 can use to evaluate and determine the reliability of the estimated signals $x^E_1[t,c]$ and/or $x^E_2[t,c]$. In this particular technique, the block 432 can use a threshold-based switch to determine the reliability of the estimated signals $x^E_1[t,c]$ and/or $x^E_2[t,c]$. If the block 432 determines that a signal (e.g., $x^E_1[t,c]$) is reliable, then that reliable signal is passed as-is to either block $\mathbf{434}_{E1}$ or block $\mathbf{434}_{E2}$ for use in a signal reconstruction process. On the other hand, if the block 432 determines that a signal (e.g., $x^E_1[t,c]$) is unreliable, then that unreliable signal is attenuated, for example, by −20 dB, and then passed to one of the $\mathbf{434}_{E1}$ or $\mathbf{434}_{E2}$ blocks.

Figure 11:
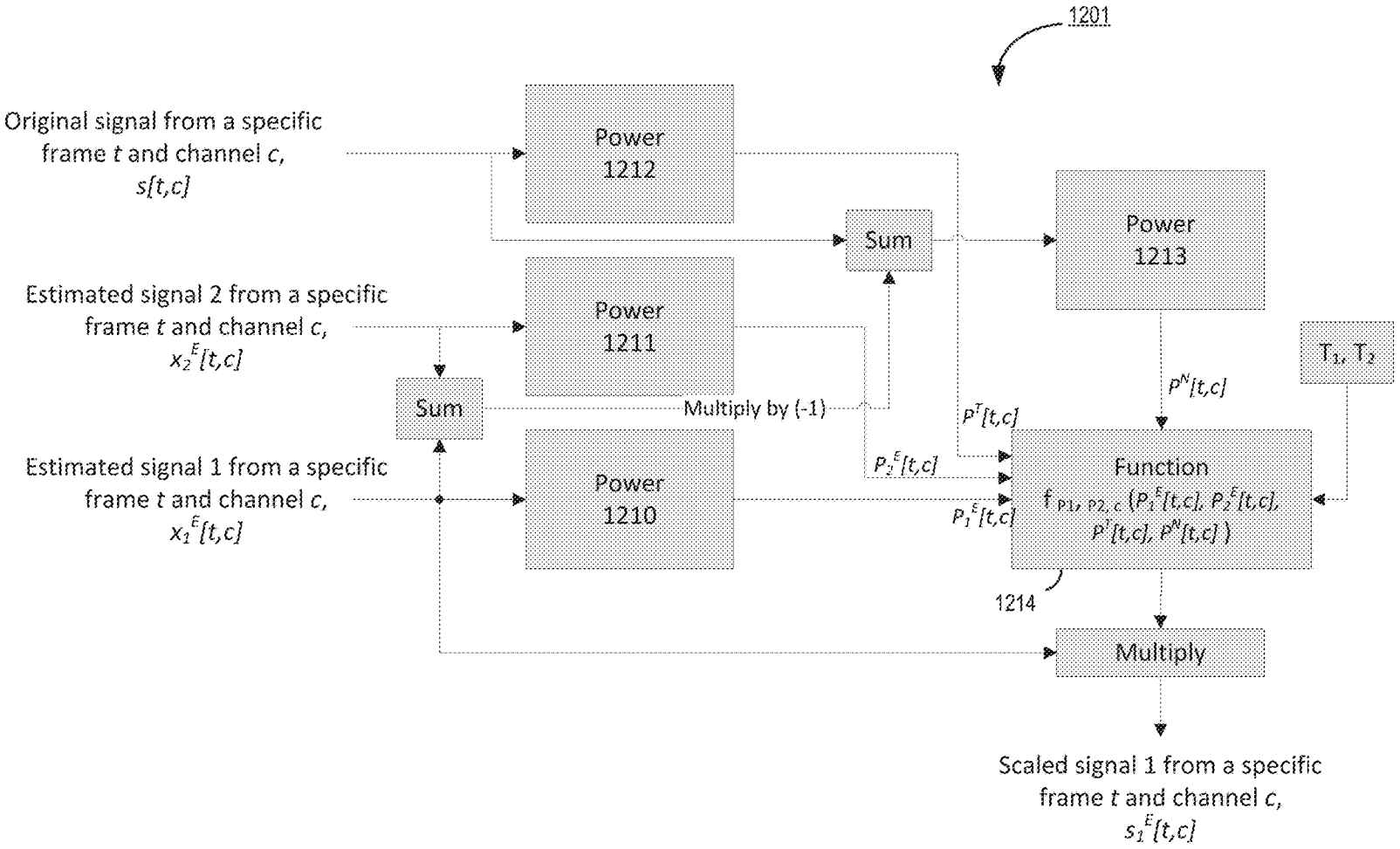
FIG. 11 is a schematic illustration of a reliability sub-module of a speech extraction system for a first speaker according to an embodiment.

FIG. 11 describes an alternative technique that block 432 can use to evaluate and determine the reliability of the estimated signals $x^E_1[t,c]$ and/or $x^E_2[t,c]$. This particular technique involves the use of a scaling function to determine the reliability of the estimated signals $x^E_1[t,c]$ and/or $x^E_2[t,c]$. If the block 432 determines that a signal (e.g., $x^E_1[t,c]$) is reliable, then that reliable signal is scaled by a certain factor and then passed to either block $\mathbf{434}_{E1}$ or block $\mathbf{434}_{E2}$ for use in a signal reconstruction process. If the block 432 determines that a signal (e.g., $x^E_1[t,c]$) is unreliable, then that unreliable signal is scaled by a certain different factor and then passed to either block $\mathbf{434}_{E1}$ or block $\mathbf{434}_{E2}$ for use in a signal reconstruction process. Regardless of the process or technique used by block 432, some version of the first estimated signal $x^E_1[t,c]$ is passed to block $\mathbf{434}_{E1}$ and some version of the second estimated signal $x^E_2[t,c]$ is passed to block $\mathbf{434}_{E2}$.

The reliability test employed by block 432 may be desirable in certain instances to ensure a quality signal reconstruction later in the speech extraction process. In some instances, the signals that a reliability block 432 receives from a segregation block 428 within a given channel can be unreliable due to the dominance of one of one speaker (e.g., speaker A) over the other speaker (e.g., speaker B). In other instances, the signal in a given channel can be unreliable due to one or more of the processes of the analysis stage being unsuitable for the input signal that is being analyzed.

Once the reliability of the estimated first signal $x^E_1[t,c]$ and the estimated second signal $x^E_2[t,c]$ is established at block 432, the estimated first signal $x^E_1[t,c]$ and the estimated second signal $x^E_2[t,c]$(or versions thereof) are passed to blocks $\mathbf{434}_{E1}$ and $\mathbf{434}_{E2}$, respectively. Block $\mathbf{434}_{E1}$ is configured to receive and combine each of the estimated first signals across all of the channels to produce a reconstructed signal $s^E_1[t]$, which is a representation of the periodic component (e.g., the voiced component) of the input signal s that corresponds to pitch estimate $P_1$. It is still unknown whether the pitch estimate $P_1$ is attributable to the first speaker (A) or the second speaker (B). Therefore, at this point in the speech extraction process, the pitch estimate $P_1$ cannot accurately be correlated with any one of the first voiced component $s_A$ or the second voiced component $s_B$. The "E" in the function of the reconstructed signal $s^E_1[t]$ indicates that this signal is only an estimate of the one of the voiced components of the input signal s.

Figure 13:
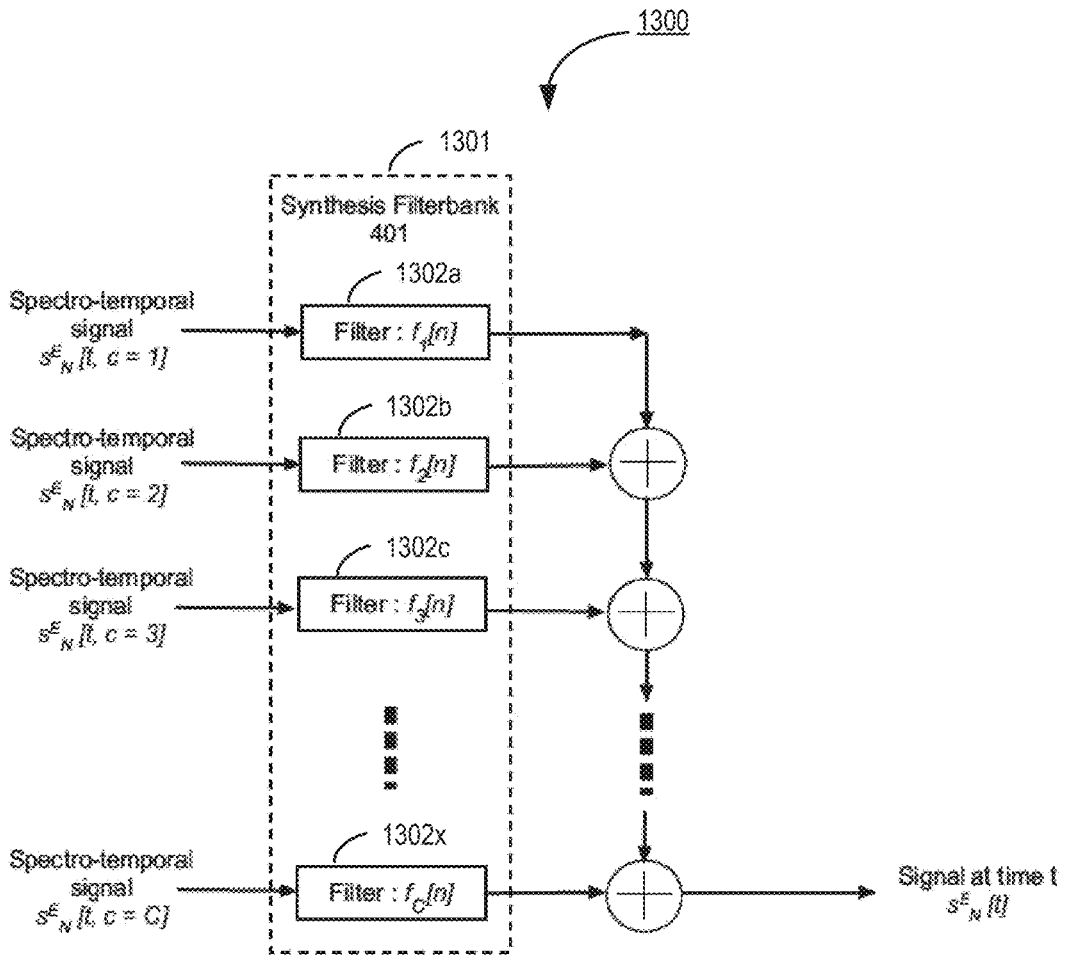
FIG. 13 is a schematic illustration of a combiner sub-module of a speech extraction system according to an embodiment.

Block $\mathbf{434}_{E2}$ is similarly configured to receive and combine each of the estimated second signals across all of the channels to produce a reconstructed signal $s^E_2[t]$, which is a representation of the periodic component (e.g., the voiced component) of the input signal s that corresponds to pitch estimate $P_2$. Likewise, the "E" in the function of the reconstructed signal $s^E_2[t]$ indicates that this signal is only an estimate of the one of the voiced components of the input signal s. FIG. 13 describes one particular technique that blocks $\mathbf{434}_{E1}$ and $\mathbf{434}_{E2}$ can use to recombine the (reliable or unreliable) estimated signals to produce reconstructed signals $s^E_1[t]$ and $s^E_2[t]$, as discussed below in more detail.

Returning to FIG. 4, after blocks $\mathbf{434}_{E1}$ and $\mathbf{434}_{E2}$, the first voiced component $s_A$ of the input signal s and the second voiced component $s_B$ of the input signal s are considered "extracted". In some embodiments, the reconstructed signals $s^E_1[t]$ and $s^E_2[t]$(i.e., the extracted estimates of the voiced component corresponding to the first pitch estimate $P_1$ and the other voiced component corresponding to the second pitch estimate $P_2$) are passed from the synthesis stage discussed above to a clustering stage 440. The processes and/or sub-modules (not illustrated) of the clustering stage 440 are configured to analyze the reconstructed signals $s^E_1[t]$ and $s^E_2[t]$ and determine which reconstructed signal belongs to the first speaker (A) and the second speaker (B). For example, if the reconstructed signal $s^E_1[t]$ is determined to be attributable to the first speaker (A), then the reconstructed signal $s^E_1[t]$ is correlated with the first voiced component $s_A$ as indicated by the output signal $s^E_A$ from the cluster stage 440. As discussed above, the "$^E$" in the function of the output signal $s^E_A$ indicates that this signal is only an estimate of the first voiced component $s_A$—albeit a very accurate estimation of the first voiced component $s_A$ as evidenced by the results illustrated in FIGS. 15A, 15B and 15C.

FIG. 5 is a block diagram of a normalization sub-module 521, which can implement a normalization process for an analysis module (e.g., block 421 within analysis module 220). More particularly, the normalization sub-module 521 is configured to process an input signal s to produce a normalized signal $s_N$. The normalization sub-module 521 includes a mean-value block 521*a*, a subtraction block 521*b*, a power block 521*c* and a division block 521*d*.

In use, the normalization sub-module 521 receives the input signal s from an acoustic device, such as a microphone. The normalization sub-module 521 calculates the mean value of the input signal s at the mean-value block 521*a*. The output of the mean-value block 521*a* (i.e., the mean value of the input signal s) is then subtracted (e.g., uniformly subtracted) from the original input signal s at the subtraction block 521*b*. When the mean-value of the input signal s is a non-zero value, the output of the subtraction block 521*b* is a modified version of the original input signal s. When the mean-value of the input signal s is zero, the output is the same as the original input signal s.

The power block 521*c* is configured to calculate the power of the output of the subtraction block 521*b* (i.e., the remaining signal after the mean value of the input signal s is subtracted from the original input signal s). The division block 521*d* is configured to receive the output of the power block 521*c* as well as the output of the subtraction block 521*b*, and then divide the output of the subtraction block 521*b* by the square root of the output of the power block 521*c*. Said another way, the division block 521*d* is configured to divide the remaining signal (after the mean value of the input signal s is subtracted from the original input signal s) by the square root of the power of that remaining signal.

The output $s_N$ of the division block 521*d* is the normalized signal $s_N$. In some embodiments, the normalization sub-module 521 processes the input signal s to produce the normalized signal $s_N$, which has unit variance and zero-mean. The normalization sub-module 521, however, can process the input signal s in any suitable manner to produce a desired normalized signal $s_N$.

In some embodiments, the normalization sub-module 521 processes the input signal s in its entirety at one time. In some embodiments, however, only a portion of the input signal s is processed at a given time. For example, in instances where the input signal s (e.g., a speech signal) is continuously arriving at the normalization sub-module 521, it may be more practical to process the input signal s in smaller window durations, "τ" (e.g., in 500 millisecond or 1 second windows). The window durations, "τ", can be, for example, pre-determined by a user or calculated based on other parameters of the system.

Although the normalization sub-module 521 is described as being a sub-module of the analysis module, in other embodiments, the normalization sub-module 521 is a stand-alone module that is separate from the analysis module.

FIG. 6 is a block diagram of a filter sub-module 622, which can implement a filtering process for an analysis module (e.g., block 422 within analysis module 220). The filter sub-module 622 shown in FIG. 6 is configured to function as a spectro-temporal filter as described herein. In other embodiments, however, the filter sub-module 622 can function as any suitable filter, such as a perfect-reconstruction filterbank or a gammatone filterbank. The filter sub-module 622 includes an auditory filterbank 622*a* with multiple filters 622$a_1$-$a_C$ and frame-wise analysis blocks 622$b_1$-$b_C$. Each of the filters 622$a_1$-$a_C$ of the filterbank 622 and the frame-wise analysis blocks 622$b_1$-$b_C$ are configured for a specific frequency channel c.

As shown in FIG. 6, the filter sub-module 622 is configured to receive and then filter an input signal s (or, alternatively, normalized input signal $s_N$) such that the input signal s is decomposed into one or more time-frequency (T-F) units. The T-F units can be represented as s[t,c], where t is time (e.g., a time frame) and c is a channel. The filtering process begins when the input signal s is passed through the filterbank 622*a*. More specifically, the input signal s is passed through C number of filters 622$a_1$-$a_C$ in the filterbank 622*a*, where C is the total number of channels. Each filter 622$a_1$-$a_C$ defines a path for the input signal and each filter path is representative of a frequency channel ("c"). Filter 622$a_1$, for example, defines a filter path and a first frequency channel (c=1) while filter 622$a_2$ defines another filter path and a second frequency channel (c=2). The filterbank 622*a* can have any number of filters and corresponding frequency channels.

As shown in FIG. 6, each filter 622$a_1$-$a_C$ is different and corresponds to a different filter equation. Filter 622$a_1$, for example, corresponds to filter equation "$h_1[n]$" and filter 622$a_2$ corresponds to filter equation "$h_2[n]$." The filters 622$a_1$-$a_C$ can have any suitable filter coefficient and, in some embodiments, can be configured based on user-defined criteria. The variations in the filters 622$a_1$-$a_C$ result in a variation of outputs from those filters 622$a_1$-$a_C$. More specifically, the output of each of the filters 622$a_1$-$a_C$ are different and thereby yield C different filtered versions of the input signal. The output from each filter 622$a_1$-$a_C$ can be mathematically represented as s[c], where the output of the filter 622$a_1$ in the first frequency channel is s[c=1] and the output of the filter 622$a_2$ in the second frequency channel is s[c=2]. Each output, s[c], is a signal containing certain frequency components of the original input signal that are better emphasized than others.

The output, s[c], for each channel is processed on a frame-wise basis by frame-wise analysis blocks 622$b_1$-$b_C$. For example, the output s[c=1] for the first frequency channel is processed by frame-wise analysis block 622$b_1$, which is within the first frequency channel. The output s[c] at a given time instant t can be analyzed by collecting together the samples from t to t+L, where L is a window length that can be user-specified. In some embodiments, the window length L is set to 20 milliseconds for a sampling rate Fs. The samples collected from t to t+L form a frame at time instant t, and can be represented as s[t,c]. The next time frame is obtained by collecting samples from t+δ to t+δ+L, where δ is the frame period (i.e., number of samples stepped over). This frame can be represented as s[t+1, c]. The frame period 6 can be user-defined. For example, the frame period 6 can be 2.5 milliseconds or any other suitable duration of time.

For a given time instant, there are C different vectors or signals (i.e., signals s[t,c] for c=1, 2 . . . C). The frame-wise analysis blocks 622$b_1$-$b_C$ can be configured to output these signals, for example, to silence detection blocks (e.g., silence detection blocks 423 in FIG. 4).

FIG. 7 is a block diagram of a silence detection sub-module 723, which can implement a silence detection process for an analysis module (e.g., block 423 within analysis module 220). More particularly, the silence detection sub-module 723 is configured to process a time-frequency unit of an input signal (represented as s[t,c]) to determine whether that time-frequency unit is non-silent. The silence detection sub-module 723 includes a power block 723*a* and a threshold block 723*b*. The time-frequency unit is first passed through the power block 723*a*, which calculates the power of the time-frequency unit. The calculated power of the time-frequency unit is then passed to the threshold block 723*b*, which compares the calculated power to a threshold value. If the calculated power is less than the threshold value then the time-frequency unit is hypothesized to contain silence. The silence detection sub-module 723 sets the time-frequency unit to zero and that time-frequency unit is discarded or ignored for the remainder of the speech extraction process. On the other hand, if the calculated power of the time-frequency unit is greater than the threshold value, then the time-frequency unit is passed, as-is, to the next stage for use in the remainder of the speech extraction process. In this manner, the silence detection sub-module 723 operates as an energy-based switch.

The threshold value used in the threshold block 723*b* can be any suitable threshold value. In some embodiments, the threshold value can be user-defined. The threshold value can be a fixed value (e.g., 0.2 or 45 dB) or can vary depending on one or more factors. For example, the threshold value can vary based on the frequency channel with which it corresponds or based on the length of the time-frequency unit being processed.

In some embodiments, the silence detection sub-module 723 can operate in a manner similar to the silence detection process described in U.S. patent application Ser. No. 12/889,298, which is incorporated by reference.

FIG. 8 is a schematic illustration of a matrix sub-module 829, which can implement a matrix formation process for an analysis module (e.g., blocks 425 and 426 within analysis module 220). The matrix sub-module 829 is configured to define a matrix M for each of the one or more pitches estimated from an input signal. More specifically, each of blocks 425 and 426 implement the matrix sub-module 829 to produce a matrix M, as discussed in more detail herein. For example, in block 425 of FIG. 4, the matrix sub-module 829 can define a matrix M for a first pitch estimate (e.g., $P_1$) and, in block 426 of FIG. 4, can separately define another matrix M for a second pitch estimate (e.g., $P_2$). As will be discussed, the matrix M for the first pitch estimate $P_1$ can be referred to as matrix $V_1$ and the matrix M for the second pitch estimate $P_2$ can be referred to as matrix $V_2$. Subsequent blocks or sub-modules (e.g., block 427) in the speech extraction process can then use the matrices V and $V_2$ to derive one or more signal component estimates of the input signal s, as described in more detail herein.

For purposes of this discussion, the matrix sub-module 829 uses pitch estimates $P_1$ and $P_2$ described in FIG. 4 with respect to block 424. For example, when the matrix sub-module 829 is implemented by block 425 in FIG. 4, the matrix sub-module 829 can receive and use the first pitch estimate $P_1$ in its calculations. When the matrix sub-module 829 is implemented by block 426 in FIG. 4, the matrix sub-module 829 can receive and use the second pitch estimate $P_2$ in its calculations. In some embodiments, the matrix sub-module 829 is configured to receive the pitch estimates $P_1$ and/or $P_2$ from a multi-pitch detection sub-module (e.g., multi-pitch detection sub-module 324). The pitch estimates $P_1$ and $P_2$ can be sent to the matrix sub-module 829 in any suitable form, such as in the number of samples. For example, the matrix sub-module 829 can receive data that indicates that 43 samples correspond to a pitch estimate (e.g., pitch estimates $P_1$) of 5.4 msec at a sampling frequency of 8,000 Hz ($F_s$). In this manner, the pitch estimate (e.g., pitch estimates $P_1$) can be fixed while the samples will vary with $F_s$. In other embodiments, however, the pitch estimates P and/or $P_2$ can be sent to the matrix sub-module 829 as pitch frequencies, which can then be internally converted into their corresponding pitch estimates in terms of number of samples.

The matrix formation process begins when the matrix sub-module 829 receives a pitch estimate $P_N$ (where N is 1 in block 425 or 2 in block 426). The pitch estimates $P_1$ and $P_2$ can be processed in any order.

The first pitch estimate $P_1$ is passed to blocks 825 and 826 and is used to form matrix $M_1$ and $M_2$. More specifically, the value of the first pitch estimate $P_1$ is applied to the function identified in block 825 as well as the function identified in block 826. The pitch estimate $P_1$ can be processed by blocks 825 and 826 in any order. For example, in some embodiments, the pitch estimates $P_1$ is first received and processed at block 825 (or vice versa) while, in other embodiments, the pitch estimate $P_1$ is received at blocks 825 and 826 in parallel or substantially simultaneously. The function of block 825 is reproduced below:

$$M_1[n,k]=e^{-j\cdot n\cdot k\cdot FS2\ pi/P_N}$$

where n is a row number of $M_1$, k is a column number of $M_1$, and $F_s$ is the sampling rate of the T-F units that correspond to the first pitch estimate $P_1$. The matrix $M_1$ can be any size with L rows and F columns. The function identified in block 826 is reproduced below with similar variables:

$$M_2[n,k]=e^{+j\cdot n\cdot k\cdot FS2\ pi/P_N}$$

It should be recognized that matrix $M_1$ differs from matrix $M_2$ in that $M_1$ applies a negative exponential while $M_2$ applies a positive exponential.

Matrices $M_1$ and $M_2$ are passed to block 827, where their respective columns F are appended together to form a single matrix M corresponding to the first pitch estimate $P_1$. The matrix M, therefore, has a size defined by L×2F and can be referred to as matrix $V_1$. The same process is applied for the second pitch estimate $P_2$ (e.g., in block 426 in FIG. 4) to form a second matrix M, which can be referred to as $V_2$. The matrices $V_1$ and $V_2$ can the be passed, for example, to block 427 in FIG. 4 and then appended together to form the matrix V.

FIG. 9 is a schematic illustration of signal segregation sub-module 928, which can implement a signal segregation process for an analysis module (e.g., block 428 within analysis module 220). More specifically, the signal segregation sub-module 928 is configured to estimate one or more components of an input signal based on previously-derived pitch estimates and then segregate those estimated components from an input signal. The signal segregation sub-module 928 performs this process using the various blocks shown in FIG. 9.

As discussed above, the input signal can be filtered into multiple time-frequency units. The signal segregation sub-module 928 is configured to serially collect one or more of these time-frequency units and define a vector x, as shown in block 951 in FIG. 9. This vector x is then passed to block 952, which also receives the matrix V and ratio F from a matrix sub-module (e.g., matrix sub-module 829). The signal segregation sub-module 928 is configured to define a vector a at block 952 using the vector x, matrix V and ratio F. Vector a can be defined as:

$$a=(V^H\cdot V)^{-1}\cdot V^H\cdot x$$

where $V^H$ is the complex conjugate of the transpose of the matrix V. Vector a can be, for example, representative of a solution for the over-determined system of equations x=V·a and can be solved using any suitable method, including iterative methods such as the singular value decomposition method, the LU decomposition method, the QR decomposition method and/or the like.

The vector a is next passed to blocks 953 and 954. At block 953, the signal segregation sub-module 928 is configured to pull the first 2F elements from vector a to form a smaller vector $b_1$. As shown in FIG. 9, vector $b_1$ can be defined as:

$$b_1=a\cdot(1:2F)$$

At block 954, the signal segregation sub-module 928 uses the remaining elements of vector a (i.e., the F elements of vector a that were not used at block 953) to form another vector $b_2$. In some embodiments, the vector $b_2$ may be zero. This may occur, for example, if the corresponding pitch estimate (e.g., pitch estimate $P_2$) for that particular signal is zero. In other embodiments, however, the corresponding pitch estimate may be zero but the vector $b_2$ can be a non-zero value.

The signal segregation sub-module 928 again uses the matrix V at block 955. Here, the signal segregation sub-module 928 is configured to pull the first two F columns from the matrix V to form the matrix $V_1$. The matrix $V_1$ can be, for example, the same as or similar to the matrix $V_1$ discussed above with respect to FIG. 8. In this manner, the signal segregation sub-module 928 can operate at block 955 to recover the previously-formed matrix $M_1$ from FIG. 8, which corresponds to the first pitch estimate $P_1$. The signal segregation sub-module 928 uses the remaining columns of the matrix V at block 956 to form the matrix $V_2$. Similarly, the matrix $V_2$ can be the same as or similar to the matrix $V_2$ discussed above with respect to FIG. 8 and, thereby, corresponds to the second pitch estimate $P_2$.

In some embodiments, the signal segregation sub-module 928 can perform the functions at blocks 955 and/or 956 before performing the functions at blocks 953 and/or 954. In some embodiments, the signal segregation sub-module 928 can perform the functions at blocks 955 and/or 956 in parallel with or at the same time as performing the functions at blocks 953 and/or 954.

As shown in FIG. 6, the signal segregation sub-module 928 next multiplies the matrix $V_1$ from block 955 with the vector $b_1$ from block 953 to produce an estimate of one of the components of the input signal, $x^E{}_1[t,c]$. Likewise, the signal segregation sub-module 928 multiplies the matrix $V_2$ from block 956 with the vector $b_2$ from block 954 to produce an estimate of another component of the input signal, $x^E{}_2[t,c]$. These component estimates $x^E{}_1[t,c]$ and $x^E{}_2[t,c]$ are the initial estimates of the periodic components of the input signal (e.g., the voiced components of the two speakers), which can be used in the remainder of the speech extraction process to determine the final estimates, as described herein.

In instances where the vector $b_2$ is zero, the corresponding estimated second component $x^E{}_2[t,c]$ will also be zero. Rather than passing an empty signal through the remainder of the speech extraction process, the signal segregation sub-module 928 (or other sub-module) can set the estimated second component $x^E{}_2[t,c]$ to an alternative, non-zero value. Said another way, the signal segregation sub-module 928 (or other sub-module) can use an alternative technique to estimate what the second component $x^E{}_2[t,c]$ should be. One technique is to derive the estimated second component $x^E{}_2[t,c]$ from the estimated first component $x^E{}_1[t,c]$. This can be done by, for example, subtracting $x^E{}_1[t,c]$ from s[t,c]. Alternatively, the power of the estimated first component $x^E{}_1[t,c]$ is subtracted from the power of the input signal (i.e., input signal s[t,c]) and then white noise with power substantially equal to this difference power is generated. The generated white noise is assigned to the estimated second component $x^E{}_2[t,c]$.

Regardless of the technique used to derive the estimated second component $x^E{}_2[t,c]$, the signal segregation sub-module 928 is configured to output two estimated components. This output can then be used, for example, by a synthesis module or any one of its sub-modules. In some embodiments, the signal segregation sub-module 928 is also configured to output a third signal estimate $x^E{}_3[t,c]$, which can be an estimate of the input signal itself. The signal segregation sub-module 928 can simply calculate this third signal estimate $x^E[t,c]$ by adding the two estimated components together—i.e., $x^E[t,c]=x^E{}_1[t,c]+x^E{}_2[t,c]$. In other embodiments, the signal can be calculated as a weighted estimate of the two estimated components, e.g., $x^E[t,c]=a_1x^E{}_1[t,c]+a_2x^E{}_2[t,c]$ where $a_1$ and $a_2$ are some user-defined constants or signal-dependent variables.

FIG. 10 is a block diagram of a first embodiment of a reliability sub-module 1100, which can implement a reliability test process for a synthesis module (e.g., block 432 within synthesis module 230). The reliability sub-module 1100 is configured to determine the reliability of the one or more estimated signals that are calculated and output by an analysis module. As previously discussed, the reliability sub-module 1100 is configured to operate as a threshold-based switch.

The reliability sub-module 1100 performs the reliability test process using the various blocks shown in FIG. 10. At the outset, the reliability sub-module 1100 receives an estimate of the input signal, $x^E[t,c]$, at blocks 1102 and 1104. As discussed above, the signal estimate $x^E[t, c]$ is the sum of the first signal estimate $x^E{}_1[t,c]$ and the second signal estimate $x^E{}_2[t,c]$. At block 1102, the power of the signal estimate $x^E[t,c]$ is calculated and identified as $P^x[t, c]$. At block 1104, the reliability sub-module 1100 receives an input signal s[t,c](e.g., signal s[t,c] shown in FIG. 4) and then subtracts the signal estimate $x^E[t,c]$ from the input signal s[t,c] to produce a noise estimate $n^E[t, c]$(also referred to as a residual signal). The power of the noise estimate $n^E[t, c]$ is the calculated at block 1104 and identified as P[t, c].

The power of the signal estimate $P^x[t, c]$ and the power of the noise estimate $P^n[t, c]$ are passed to block 1106, which calculates the ratio of the power of the signal estimate $P^x[t, c]$ to the power of the noise estimate $P^n[t, c]$. More particularly, block 1106 is configured to calculate the signal-to-noise ratio of the signal estimate $x^E[t,c]$. This ratio is identified in block 1106 as $P^x[t, c]/P^n[t, c]$ and is further identified in FIG. 10 as signal-to-noise ratio SNR[t,c].

The signal-to-noise ratio SNR[t,c] is passed to block 1108, which provides the reliability sub-module 1100 with its switch-like functionality. At block 1108, the signal-to-noise ratio SNR[t,c] is compared with a threshold value, which can be defined as T[t, c]. The threshold T[t, c] can be any suitable value or function. In some embodiments, the threshold T[t, c] is a fixed value while, in other embodiments, the threshold T[t, c] is an adaptive threshold. For example, in some embodiments, the threshold T[t, c] varies for each channel and time unit. The threshold T[t, c] can be a function of several variables, such as, for example, a variable of the signal estimate $x^E[t,c]$ and/or the noise estimate $n^E[t, c]$ from the previous or current T-F units (i.e., signal s[t,c]) analyzed by the reliability sub-module 1100.

As shown in FIG. 10, if the signal-to-noise ratio SNR[t,c] does not exceed the threshold T[t, c] at block 1108, then the signal estimate $x^E[t,c]$ is deemed by the reliability sub-module 1100 to be an unreliable estimate. In some embodiments, when the signal estimate $x^E[t,c]$ is deemed unreliable, one or more of its corresponding signal estimates (e.g., $x^E{}_1[t,c]$ and/or $x^E{}_2[t,c]$) are also deemed unreliable estimates. In other embodiments, however, each of the corresponding signal estimates are evaluated by the reliability sub-module 1100 separately and the results of each have little to no baring on the other corresponding signal estimates. If the signal-to-noise ratio SNR[t,c] does exceed the threshold T[t, c] at block 1108, then the signal estimate $x^E[t,c]$ is deemed to be a reliable estimate.

After the reliability of the signal estimate $x^E[t,c]$ is determined, the appropriate scaling value (identified as m[t,c] in FIG. 10) is passed to block 1110 (or block 1112) to be multiplied with the signal estimates $x^E_1[t,c]$ and/or $x^E_2[t,c]$. As shown in FIG. 10, the scaling value m[t,c] for the unreliable signal estimates is set at 0.1 while the scaling value m[t,c] for the reliable signal estimates is set at 1.0. The unreliable signal estimates are therefore reduced to a tenth of their original power while the power of the reliable estimates remains the same. In this manner, the reliability sub-module 1100 passes the reliable signal estimates to the next processing stage without modification (i.e., as-is). The signals passed to the next processing stage (modified or as-is) are referred respectively to as $s^E_1[t,c]$ and $s^E_2[t,c]$.

FIG. 13 is a schematic illustration of a combiner sub-module 1300, which can implement a reconstruction or re-composition process for a synthesis module (e.g., blocks 434 within synthesis module 230). More specifically, the combiner sub-module 1300 is configured to receive signal estimates $s^E_N[t,c]$ from a reliance sub-module (e.g., reliability sub-module 432) for each channel c and combine those signal estimates $s^E_N[t,c]$ to produce a reconstructed signal $s^E_N[t]$. Here, the variable "N" can be either 1 or 2 as they relate to pitch estimates $P_1$ and $P_2$, respectively.

As shown in FIG. 13, the signal estimates $s^E_N[t,c]$ are passed through filterbank 1301 that includes a set of filters 1302*a-x* (collectively, 1302). Each channel c includes one filter (e.g., filter 1302*a*) that is configured for its respective frequency channel c. In some embodiments, the parameters of the filters 1302 are user-defined. The filterbank 1301 can be referred to as a reconstruction filterbank. The filterbank 1301 and the filters 1302 therein can be any suitable filterbank and/or filter configured to facilitate the reconstruction of one or more signals across a plurality of channels c.

Once the signal estimates $s^E_N[t,c]$ are filtered, the combiner sub-module 1300 is configured to aggregate the filtered signal estimates $s^E_N[t,c]$ across each channel to produce a single signal estimate $s^E[t]$ for a given time t. The single signal estimate $s^E[t]$, therefore, is no longer a function of the one or more channels. Additionally, T-F units no longer exist in the system for this particular portion of the input signal s at a given time t.

Figure 14A:
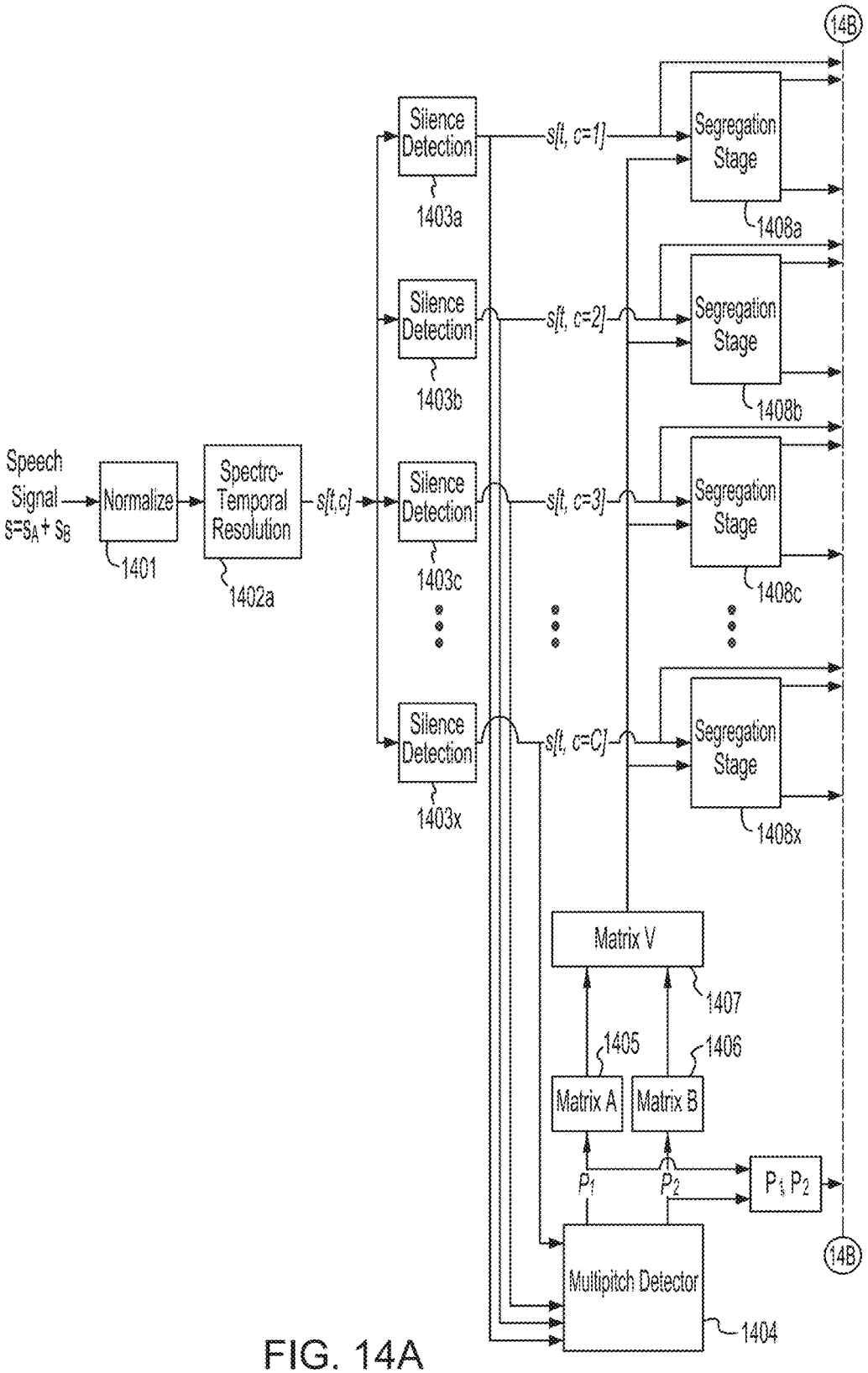
FIGS. 14A and 14B are block diagrams of a speech extraction system according to another embodiment.
Figure 14B:
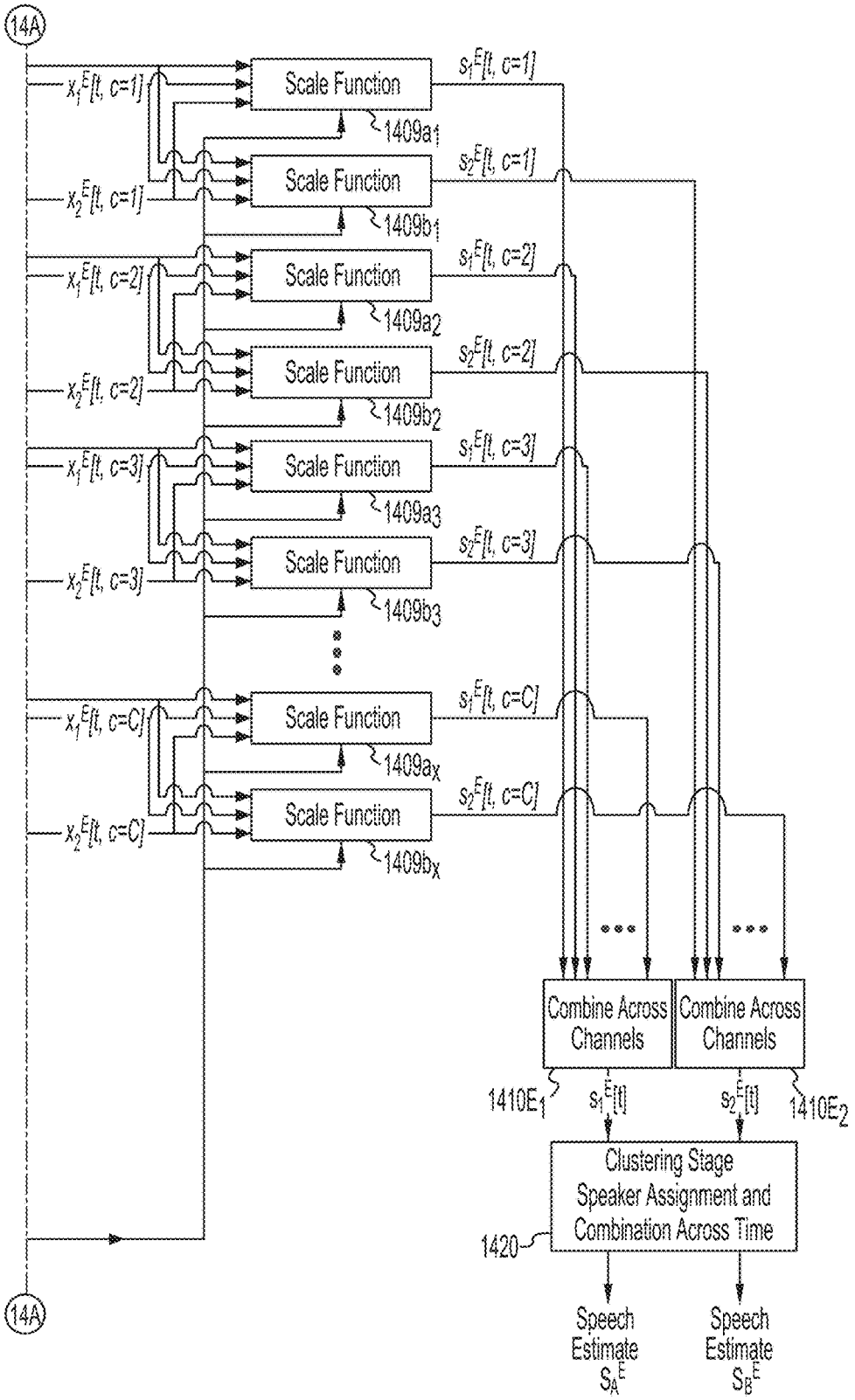

FIGS. 14A and 14B illustrate an alternative embodiment for implementing a speech segregation process 1400. Blocks 1401, 1402, 1403, 1405, 1406, 1407, $\mathbf{1410}_{E1}$ and $\mathbf{1410}_{E2}$ of the speech segregation process function and operate in a similar manner to respective blocks 421, 422, 423, 425, 426, 427, $\mathbf{434}_{E1}$ and $\mathbf{434}_{E2}$ of the speech segregation process 400 shown in FIG. 4 and, therefore, are not described in detail herein. The speech segregation process 1400 differs, at least in part, from the speech segregation process 400 shown in FIG. 4 with respect to the mechanism or process within which the speech segregation process 1400 determines the reliability of an estimated signal. Only those components of the speech segregation process 1400 that differ from the speech segregation process 400 shown in FIG. 4 will be discussed in detail herein.

The speech segregation process 1400 includes a multipitch detector block 1404 that operates and functions in a manner similar to the multipitch detector block 424 illustrated and described in FIG. 4. The multipitch detector block 1404, however, is configured to pass the pitch estimates $P_1$ and $P_2$ directly to the scale function block 1409, in addition to passing the pitch estimates $P_1$ and $P_2$ to matrix blocks 1405 and 1406 for further processing.

The speech segregation process 1400 includes a segregation block 1408, which also operates and functions in a manner similar to the segregation block 428 illustrated and described in FIG. 4. The segregation block 1408, however, only calculates and outputs two signal estimates for further processing—i.e., a first signal $x^E_1[t,c]$(i.e., an estimate corresponding to the first pitch estimate $P_1$) and a second signal $x^E_2[t,c]$(i.e., an estimate corresponding to the second pitch estimate $P_2$). The segregation block 1408, therefore, does not calculate a third signal estimate (e.g., an estimate of the total input signal). In some embodiments, however, the segregation block 1408 can calculate such a third signal estimate. The segregation block 1408 can calculate the first signal estimate $x^E_1[t,c]$ and the second signal estimate $x^E_2[t,c]$ in any manner discussed above with reference to FIG. 4.

The speech segregation process 1400 includes a first scale function block 1409*a* and a second scale function block 1409*b*. The first scale function block 1409*a* is configured to receive the first signal estimate $x^E_1[t,c]$ and the pitch estimates $P_1$ and $P_2$ passed from the multipitch detector block 1404. The first scale function block 1409*a* can evaluate the first signal estimate $x^E_1[t,c]$ to determine the reliability of that signal using, for example, a scaling function that is derived specifically for that signal. In some embodiments, the scaling function for the first signal estimate $x^E_1[t,c]$ can be a function of a power of the first signal estimate (e.g., $P_1[t, c]$), a power of the second signal estimate (e.g., $P_2[t, c]$), a power of a noise estimate (e.g., $P^n[t, c]$), a power of the original signal (e.g., $P^t[t, c]$), and/or a power of an estimate of the input signal (e.g., $P^x[t, c]$). The scaling function at the first scale function block 1409*a* can further be configured for the specific frequency channel within which the specific first scale function block 1409*a* resides. FIG. 11 describes one particular technique that the first scale function block 1409*a* can use to evaluate the first signal estimate $x^E_1[t,c]$ to determine its reliability.

Figure 12:
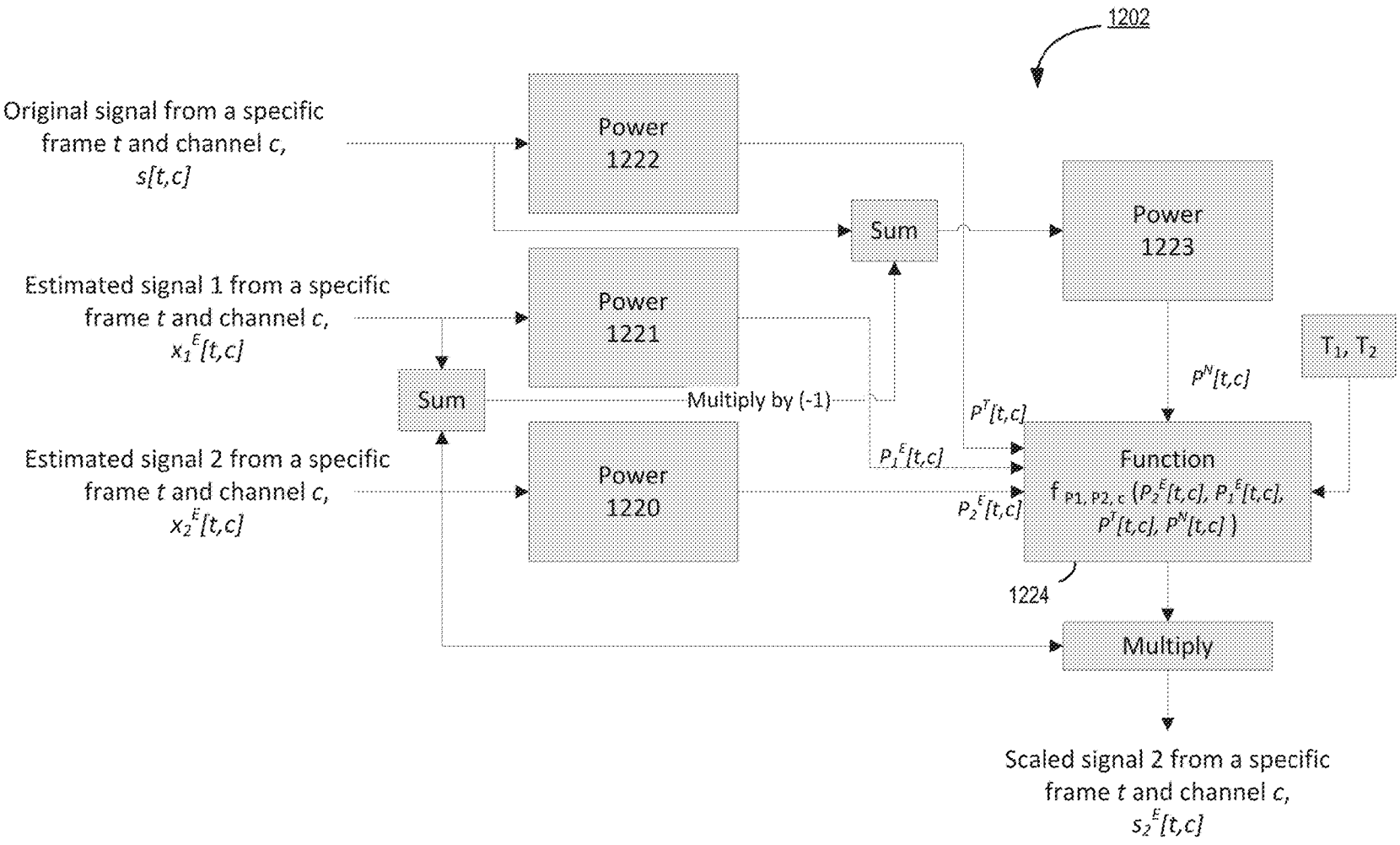
FIG. 12 is a schematic illustration of the reliability sub-module of a speech extraction system for a second speaker according to an embodiment.

Returning to FIGS. 14A and 14B, the second scale function block 1409*b* (shown in FIG. 14B) is configured to receive the second signal estimate $x^E_2[t,c]$ as well as the pitch estimates $P_1$ and $P_2$. The second scale function block 1409*b* can evaluate the second signal estimate $x^E_2[t,c]$ to determine the reliability of that signal using, for example, a scaling function that is derived specifically for that signal. Said another way, in some embodiments, the scaling function used at the second scale function block 1409*b* to evaluate the second signal estimate $x^E_2[t,c]$ is unique to that second signal estimate $x^E_2[t,c]$. In this manner, the scaling function at the second scale function block 1409*b* can be different from the scaling function at the first scale function block 1409*a*. In some embodiments, the scaling function for the second signal estimate $x^E_2[t,c]$ can be a function of a power of the first signal estimate (e.g., $P_1[t, c]$), a power of the second signal estimate (e.g., $P_2[t, c]$), a power of a noise estimate (e.g., $P^n[t, c]$), a power of the original signal (e.g., $P^t[t, c]$), and/or a power of an estimate of the input signal (e.g., P[t, c]). Moreover, the scaling function at the second scale function block 1409*b* can be configured for the specific frequency channel within which the specific second scale function block 1409*b* resides. FIG. 12 describes one particular technique that the second scale function block 1409*b* can use to evaluate the second signal estimate $x^E_2[t,c]$ to determine its reliability.

Returning to FIGS. 14A and 14B, after the first signal estimate $x^E_1[t,c]$ is processed at the first scale function block

1409*a*, that processed first signal estimate, which is now represented as $s^E_1[t,c]$, is passed to block $\mathbf{1410}_{E1}$ for further processing. Likewise, after the second signal estimate $x^E_2[t,c]$ is processed at the second scale function block 1409*b*, that processed second signal estimate, which is now represented as $s^E_2[t,c]$, is passed to block $\mathbf{1410}_{E2}$ for further processing. Blocks $\mathbf{1410}_{E1}$ and $\mathbf{1410}_{E2}$ can function and operate in a manner similar to blocks $\mathbf{434}_{E1}$ and $\mathbf{434}_{E2}$ illustrated and described with respect to FIG. 4.

FIG. 11 is a block diagram of a scaling sub-module 1201 adapted for use with a first signal estimate (e.g., first signal estimate $x^E_1[t,c]$). FIG. 12 is a block diagram of a scaling sub-module 1202 adapted for use with a second signal estimate (e.g., second signal estimate $x^E_2[t,c]$). The process implemented by the scaling sub-module 1201 in FIG. 11 is substantially similar to the process implemented by the scaling sub-module 1202 in FIG. 12, with the exception of the derived function in blocks 1214 and 1224, respectively.

Referring first to FIG. 11, at block 1210, the scaling sub-module 1201 is configured to receive the first signal estimate $x^E_1[t,c]$ from, for example, a segregation block, and calculate the power of the first signal estimate $x^E_1[t,c]$. This calculated power is represented as $P^E_1[t,c]$. At block 1211, the scaling sub-module 1201 is configured to receive the second signal estimate $x^E_2[t,c]$ from, for example, the same segregation block, and calculate the power of the second signal estimate $x^E_2[t,c]$. This calculated power is represented as $P^E_2[t, c]$. Similarly, at block 1212, the scaling sub-module 1201 is configured to receive the input signal s[t,c](or at least some T-F unit of the input signal s), and calculate the power of the input signal s[t,c]. This calculated power is represented as $P^T[t, c]$.

Block 1213 receives the following string of signals: $s[t,c]-(x^E_1[t,c]+x^E_2[t,c])$. More specifically, block 1213 receives the residual signal (i.e., noise signal) which is calculated by subtracting the estimate of the input signal (defined as $x^E_1[t,c]+x^E_2[t, c]$) from the input signal s[t,c]. Block 1213 then calculates the power of this residual signal. This calculated power is represented as $P^N[t,c]$.

The calculated powers $P^E_1[t,c]$, $P^E_2[t, c]$, and $P^T[t, c]$ are fed into block 1214 along with the power $P^N[t,c]$ from block 1213. The function block 1214 generates a scaling function $\lambda_1$ based on the above inputs and then multiples the scaling function $\lambda_1$ to the first signal estimate $x^E_1[t,c]$ to produce a scaled signal estimate $s^E_1[t, c]$. The scaling function $\lambda_1$ is represented as:

$$\lambda_1=f_{P1,P2,c}(P^E_1[t,c],P^E_2[t,c],P^T[t,c],P^N[t,c]).$$

The scaled signal estimate $s^E_1[t, c]$ is then passed to a subsequent process or sub-module in the speech segregation process. In some embodiments, the scaling function $\lambda_1$ can be different (or adaptable) for each channel. For example, in some embodiments, each of the pitch estimates $P_1$ and/or $P_2$ and/or each channel, can have its own individual pre-defined scaling functions $\lambda_1$ or $\lambda_2$.

Referring now to FIG. 12, blocks 1220, 1221, 1222 and 1223 function in a manner similar to blocks 1210, 1211, 1212 and 1213 shown in FIG. 11, respectively, and are therefore not discussed in detail herein. The function block 1224 generates a scaling function $\lambda_2$ based on the above inputs and then applies the scaling function $\lambda_2$ to the second signal estimate $x^E_2[t,c]$ to produce a scaled signal estimate $s^E_2[t, c]$. The scaling function $\lambda_2$ is represented as:

$$\lambda_2=f_{P1,P2,c}(P^E_2[t,c],P^E_1[t,c],P^T[t,c],P^n[t,c]).$$

The placement of the power estimates $P^E_2[t, c]$ and $P^E_1[t,c]$ in the scaling function $\lambda_2$ differs from the placement of those same estimates in the scaling function $\lambda_1$. For the scaling function $\lambda_2$ shown in FIG. 12, the power estimate $P^E_2[t, c]$ takes a higher precedence in the function. For the scaling function $\lambda_1$ shown in FIG. 11, however, the power estimate $P^E_1[t, c]$ takes a higher precedence in the function. Otherwise, the scaling functions $\lambda_1$ and $\lambda_2$ are almost identical. For this particular part of the input signal, the speech component corresponding to the first speaker (i.e., the first signal estimate $x^E_1[t,c]$) is generally stronger than the speech component corresponding to the second speaker (i.e., the second signal estimate $x^E_2[t,c]$). This difference in energy can be seen by comparing the amplitude of the waveform in FIGS. 15A-C.

Figure 15A:
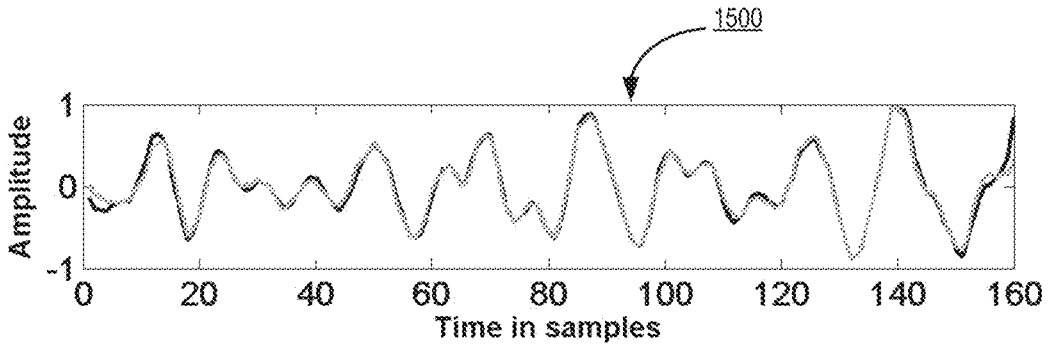
FIG. 15A is a graphical representation of a speech mixture before speech extraction processing according to an embodiment.
Figure 15B:
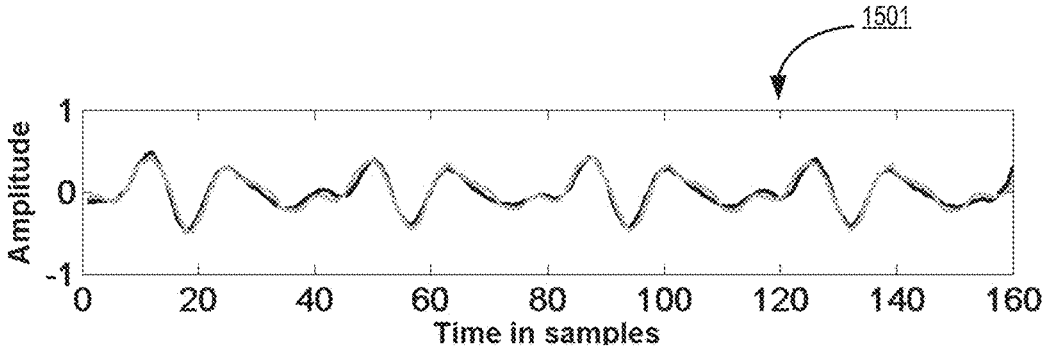
FIG. 15B is a graphical representation of the speech illustrated in FIG. 15A after speech extraction processing for a first speaker.
Figure 15C:
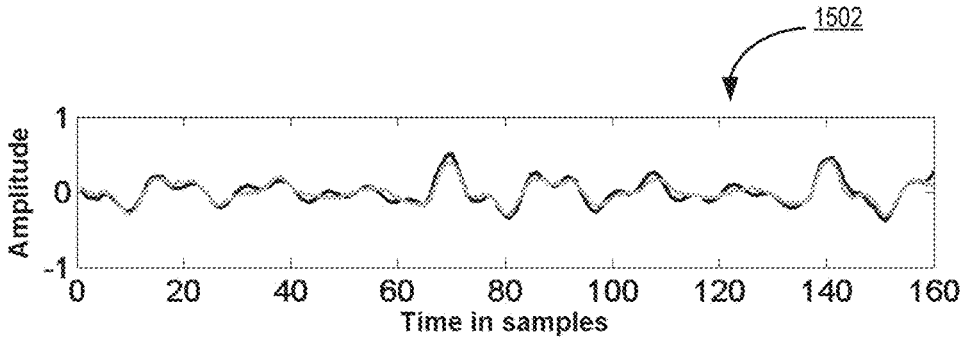
FIG. 15C is a graphical representation of the speech illustrated in FIG. 15A after speech extraction processing for a second speaker.

FIGS. 15A, 15B and 15C illustrate examples of the speech extraction process in practical applications. FIG. 15A is graphical representation 1500 of a true speech mixture (black line) overlapped by an extracted or estimated signal (grey line). The true speech mixture includes two periodic components (not identified) from, for example, two different speakers (A and B). In this manner, the true speech mixture includes a first voiced component A and a second voiced component B. In some embodiments, however, the true speech mixture can include one or more non-speech components (represented by A and/or B). The true speech mixture can also include undesired non-periodic or unvoiced components (e.g., noise). As shown in FIG. 15, there is a close match between the extracted signal (grey line) and the true speech mixture (black line).

FIG. 15B is a graphical representation 1501 of the true first signal component from the true speech mixture (black line) overlapped by an estimated first signal component (grey line) extracted using the speech extraction process. The true first signal component can represent, for example, the speech of the first speaker (i.e., speaker A). As shown in FIG. 15B, the extracted first signal component closely models the true first signal component, both in terms of its amplitude (or relative contribution to the speech mixture) and its temporal properties, and fine structure.

FIG. 15C is a graphical representation 1502 of the true second signal component from the true speech mixture (black line) overlapped by an estimated second signal component (grey line) extracted using the speech extraction process. The true second signal component can represent, for example, the speech of the second speaker (i.e., speaker B). While a close match exists between the extracted second signal component and the true second signal component, the extracted second signal component is not as close of a match to the true second signal component as the extracted first signal component is to the true first signal component. This is, in part, due to the true first signal component being stronger than the true second signal component—i.e., the first speaker is stronger than the second speaker. The second signal component, in fact, is approximately 6 dB (or 4 times) weaker than the first signal component. The extracted second component, however, is still closely models the true second component both in its amplitude and temporal, fine structure.

FIG. 15C illustrates an example of a characteristic of the speech extraction system/process—even though this particular portion of the speech mixture was dominated by the first speaker, the speech extraction process was still able to extract information for the second speaker and share the mixture energy between both speakers.

While various embodiments have been described above, it should be understood that they have been presented by way of example only, and not limitation. Where methods described above indicate certain events occurring in certain order, the ordering of certain events may be modified. Additionally, certain of the events may be performed concurrently in a parallel process when possible, as well as performed sequentially as described above.

Although the analysis module 220 is illustrated and described in FIG. 3 as including the filter sub-module 321, the multi-pitch detector sub-module 324 and the signal segregation sub-module 328 and their respective functionalities, in other embodiments, the synthesis module 230 can include any one of the filter sub-module 321, the multi-pitch detector sub-module 324 and/or the signal segregation sub-module 328 and/or their respective functionalities. Likewise, although the synthesis module 230 is illustrated and described in FIG. 3 as including the function sub-module 332 and the combiner sub-module 334 and their respective functionalities, in other embodiments, the analysis module 220 can include any one of the function sub-module 332 and/or the combiner sub-module 334, and/or their respective functionalities. In yet other embodiments, one or more of the above sub-modules can be separate from the analysis module 220 and/or the synthesis module 230 such that they are stand-alone modules or are sub-modules of another module.

In some embodiments, the analysis module or, more specifically, the multi-pitch tracking sub-module can use the 2-D average magnitude difference function (AMDF) to detect and estimate two pitch periods for a given signal. In some embodiments, the 2-D AMDF method can be modified to a 3-D AMDF so that three pitch periods (e.g., three speakers) can be estimated simultaneously. In this manner, the speech extraction process can detect or extract the overlapping speech components of three different speakers. In some embodiments, analysis module and/or the multi-pitch tracking sub-module can use the 2-D autocorrelation function (ACF) to detect and estimate two pitch periods for a given signal. Similarly, in some embodiments, the 2-D ACF can be modified to a 3-D ACF.

In some embodiments, the speech extraction process can be used to process signals in real-time. For example, the speech extraction can be used to process input and/or output signals derived from a telephone conversation during that telephone conversation. In other embodiments, however, the speech extraction process can be used to process recorded signals.

Although the speech extraction process is discussed above as being used in audio devices, such as cell phones, for processing signals with a relatively low number of components (e.g., two or three speakers), in other embodiments, the speech extraction process can be used on a larger scale to process signals having any number of components. For example, the speech extraction process can identify 20 speakers from a signal that includes noise from a crowded room. It should be understood, however, that the processing power used to analyze a signal increases as the number of speech components to be identified increases. Therefore, larger devices having greater processing power, such as supercomputers or mainframe computers, may be better suited for processing these signals.

In some embodiments, any one of the components of the device 100 shown in FIG. 1 or any one of the modules shown in FIG. 2 or 3 can include a computer-readable medium (also can be referred to as a processor-readable medium) having instructions or computer code thereon for performing various computer-implemented operations. The media and computer code (also can be referred to as code) may be those designed and constructed for the specific purpose or purposes. Examples of computer-readable media include, but are not limited to: magnetic storage media such as hard disks, floppy disks, and magnetic tape; optical storage media such as Compact Disc/Digital Video Discs (CD/DVDs), Compact Disc-Read Only Memories (CD-ROMs), and holographic devices; magneto-optical storage media such as optical disks; carrier wave signal processing modules; and hardware devices that are specially configured to store and execute program code, such as Application-Specific Integrated Circuits (ASICs), Programmable Logic Devices (PLDs), and Read-Only Memory (ROM) and Random-Access Memory (RAM) devices.

Examples of computer code include, but are not limited to, micro-code or micro-instructions, machine instructions, such as produced by a compiler, code used to produce a web service, and files containing higher-level instructions that are executed by a computer using an interpreter. For example, embodiments may be implemented using Java, C++, or other programming languages (e.g., object-oriented programming languages) and development tools. Additional examples of computer code include, but are not limited to, control signals, encrypted code, and compressed code.

Although various embodiments have been described as having particular features and/or combinations of components, other embodiments are possible having a combination of any features and/or components from any of embodiments where appropriate.

What is claimed is:

1. A non-transitory processor-readable medium storing code representing instructions to cause a processor to perform a process of reconstructing a voiced speech signal, the code comprising code to:

receive an input signal simultaneously having a first component associated with a first source and a second component associated with a second source different from the first source, the first component being a voiced speech signal, the second component being noise;

sample the input signal at a specified frame rate for a plurality of frames, each frame from the plurality of frames being associated with a plurality of frequency channels;

calculate an estimate of the first component of the input signal based on an estimate of a pitch of the first component of the input signal at each frequency channel from the plurality of frequency channels for each frame from the plurality of frames;

calculate an estimate of the input signal based on each estimate of the first component of the input signal and an estimate of the second component of the input signal; and modify each estimate of the first component of the input signal at each frequency channel from the plurality of frequency channels for each frame from the plurality of frames based on a scaling function that is adaptive based on that frequency channel to produce a reconstructed first component of the input signal, the reconstructed first component of the input signal being produced after each modified estimate of the first component of the input signal is combined across each frequency channel from the plurality of frequency channels for each frame from the plurality of frames, the scaling function being a function of at least one of the input signal, the estimate of the first component of the input signal, the estimate of the second component of the input signal, or a residual signal derived from the input signal and the estimate of the input signal.

2. The non-transitory processor-readable medium of claim 1, further comprising code to:

calculate the estimate of the second component of the input signal based on an estimate of a pitch of the second component of the input signal.

3. The non-transitory processor-readable medium of claim 1, wherein the scaling function is a first scaling function, the processor-readable medium further comprising code to:

modify the estimate of the second component of the input signal based on a second scaling function to produce a reconstructed second component of the input signal, the second scaling function being different from the first scaling function and being a function of at least one of the input signal, the estimate of the first component of the input signal, the estimate of the second component of the input signal or the residual signal.

4. The non-transitory processor-readable medium of claim 1, further comprising code to:

assign the first source to the first component of the input signal based on at least one characteristic of the reconstructed first component of the input signal.

5. The non-transitory processor-readable medium of claim 1, wherein the scaling function is configured to operate as one of a non-linear function, a linear function or a threshold-based switch.

6. The non-transitory processor-readable medium of claim 1, wherein the residual signal corresponds to the estimate of the input signal subtracted from the input signal.

7. The non-transitory processor-readable medium of claim 1, wherein the processor is a digital signal processor of a device of a user, the code being downloaded to the processor-readable medium.

8. The non-transitory processor-readable medium of claim 1, wherein the scaling function is a function of a power of the estimate of the first component of the input signal, a power of the estimate of the second component of the input signal, a power of the input signal and a power of the residual signal.

9. The non-transitory processor-readable medium of claim 1, wherein the scaling function is adaptive for the estimate of the first component of the input signal based on the estimate of the pitch of the first component of the input signal.

10. A system of reconstructing a voiced speech signal, comprising:

at least one computer memory configured to store an analysis module and a synthesis module, the analysis module configured to receive an input signal simultaneously having a first component associated with a first source and a second component associated with a second source different from the first source, the first component being a voiced speech signal, the second component being noise, the analysis module configured to calculate a first signal estimate associated with the first component of the input signal, the analysis module configured to calculate a second signal estimate associated with at least one of the first component of the input signal or the second component of the input signal, the analysis module configured to calculate a third signal estimate derived from the first signal estimate and the second signal estimate; and the synthesis module configured to modify the first signal estimate based on a scaling function to produce a reconstructed first component of the input signal and to modify the second signal estimate based on the scaling function, the scaling function being a function derived from at least one of a power of the input signal, a power of the first signal estimate, a power of the second signal estimate, or a power of a residual signal calculated based on the input signal and the third signal estimate.

11. The system of claim 10, wherein the at least one computer memory is configured to store a cluster module configured to assign the first source to the first component of the input signal based on at least one characteristic of the reconstructed first component of the input signal.

12. The system of claim 10, wherein the analysis module is configured to estimate a pitch of the first component of the input signal to produce an estimated pitch of the first component of the input signal, the analysis module is configured to calculate the first signal estimate based on the estimated pitch of the first component of the input signal.

13. The system of claim 10, wherein the synthesis module is configured to calculate the residual noise by subtracting the third signal estimate from the input signal.

14. The system of claim 10, wherein the scaling function is adaptive based on a frequency channel of the first component of the input signal or a pitch estimate of the first component of the input signal.

15. The system of claim 10, wherein the first component is substantially periodic.

16. The system of claim 10, wherein the analysis module is configured to calculate the second signal estimate based on the power of the first signal estimate and the power of the input signal.

17. A non-transitory processor-readable medium storing code representing instructions to cause a processor to perform a process of reconstructing a voiced speech signal, the code comprising code to:

receive a first signal estimate associated with a component of an input signal for a frequency channel from a plurality of frequency channels, the input signal simultaneously having a first component associated with a first source and a second component associated with a second source different from the first source, the first component being a voiced speech signal, the second component being noise;

receive a second signal estimate associated with the input signal for the frequency channel from the plurality of frequency channels, the second signal estimate being derived from the first signal estimate;

calculate a scaling function based on at least one of the frequency channel from the plurality of frequency channels, a power of the first signal estimate, or a power of a residual signal derived from the second signal estimate and the input signal;

modify the first signal estimate for the frequency channel from the plurality of frequency channels based on the scaling function to produce a modified first signal estimate for the frequency channel from the plurality of frequency channels; and combine the modified first signal estimate for the frequency channel from the plurality of frequency channels with a modified first signal estimate for each remaining frequency channel from the plurality of frequency channels to reconstruct the component of the input signal to produce a reconstructed component of the input signal.

* * * * *